US007651210B2

(12) United States Patent
Esplin et al.

(10) Patent No.: US 7,651,210 B2
(45) Date of Patent: Jan. 26, 2010

(54) TRANSPORT SYSTEM FOR SOLID INK FOR COOPERATION WITH MELT HEAD IN A PRINTER

(75) Inventors: Ernest Isreal Esplin, Sheridan, OR (US); Michael Alan Fairchild, Vancouver, WA (US); Chad David Freitag, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 564 days.

(21) Appl. No.: 11/602,938

(22) Filed: Nov. 21, 2006

(65) Prior Publication Data

US 2008/0117266 A1 May 22, 2008

(51) Int. Cl.
*B41J 2/175* (2006.01)

(52) U.S. Cl. ..... 347/88

(58) Field of Classification Search ..... 347/85, 347/88, 99

See application file for complete search history.

(56) References Cited

U.S. PATENT DOCUMENTS 4,636,803 A * 1/1987 Mikalsen ..... 347/88
5,123,961 A * 6/1992 Yamamoto ..... 106/31.29
5,223,860 A 6/1993 Loofbourow et al.
5,276,468 A 1/1994 Deur et al.
5,341,164 A 8/1994 Miyazawa et al.
5,442,387 A 8/1995 Loofbourow et al.
5,510,821 A 4/1996 Jones et al.
5,689,288 A 11/1997 Wimmer et al.
5,734,402 A 3/1998 Rousseau et al.
5,784,089 A 7/1998 Crawford
5,861,903 A 1/1999 Crawford et al.
5,917,528 A 6/1999 Grellmann et al.
5,975,690 A 11/1999 Grellmann et al.
5,988,805 A 11/1999 Meinhardt
6,053,608 A 4/2000 Ishii et al.
6,056,394 A 5/2000 Rousseau et al.
6,109,803 A * 8/2000 Yasui et al. ..... 400/320
6,543,867 B1 4/2003 Jones
6,561,636 B1 5/2003 Jones
6,565,200 B1 5/2003 Jones
6,565,201 B1 5/2003 Jones
6,572,225 B1 6/2003 Jones
6,648,435 B1 11/2003 Jones
6,679,591 B2 1/2004 Jones
6,705,710 B2 3/2004 Jones et al.
6,709,094 B2 3/2004 Jones
6,719,413 B2 4/2004 Jones
6,719,419 B2 4/2004 Jones et al.
6,739,713 B2 5/2004 Jones et al.

(Continued)

*Primary Examiner*—Anh T. N. Vo
(74) *Attorney, Agent, or Firm*—Maginot, Moore & Beck

(57) ABSTRACT

An ink delivery system for use with a solid ink stick for use in printers is provided. The ink delivery system is used for receiving the stick and converting it to molten ink that may be transferred to media to form an image on the media. The delivery system includes a guide for receiving the stick and guiding the stick in a prescribed path and a melting unit. The melting unit is operably associated with the guide. The melting unit converts the stick to molten ink. The melting unit defines a receiving surface for receiving a first end of the stick. The receiving surface defines a plane. The guide defines a longitudinal axis of the guide adjacent the melting unit. The longitudinal axis defines an acute angle with respect to the plane.

13 Claims, 30 Drawing Sheets

U.S. PATENT DOCUMENTS

| | | | |
|---|---|---|---|
| 6,746,113 | B1 | 6/2004 | Leighton et al. |
| 6,755,517 | B2 | 6/2004 | Jones et al. |
| 6,761,443 | B2 | 7/2004 | Jones |
| 6,761,444 | B2 | 7/2004 | Jones et al. |
| 6,772,764 | B2 | 8/2004 | Chapman |
| 6,824,241 | B2 | 11/2004 | Sonnichsen et al. |
| 6,840,612 | B2 | 1/2005 | Jones et al. |
| 6,840,613 | B2 | 1/2005 | Jones |
| 6,866,375 | B2 | 3/2005 | Leighton et al. |
| 6,895,191 | B2 | 5/2005 | Rommelmann et al. |
| 6,905,201 | B2 | 6/2005 | Leighton |
| 6,929,360 | B2 | 8/2005 | Jones |
| 6,966,644 | B2 | 11/2005 | Jones et al. |
| 6,981,754 | B2 | 1/2006 | Godil et al. |
| 6,986,570 | B2 | 1/2006 | Jones et al. |
| 7,066,589 | B2 | 6/2006 | Jones et al. |
| 7,104,635 | B2 | 9/2006 | Jones |
| 2003/0202066 | A1 | 10/2003 | Jones |
| 2003/0202067 | A1 | 10/2003 | Jones et al. |
| 2003/0202069 | A1 | 10/2003 | Jones |
| 2003/0202071 | A1 | 10/2003 | Jones et al. |
| 2003/0202077 | A1 | 10/2003 | Jones et al. |
| 2003/0222930 | A1 | 12/2003 | Jones |
| 2003/0222951 | A1 | 12/2003 | Jones |
| 2003/0222952 | A1 | 12/2003 | Jones |
| 2003/0222953 | A1 | 12/2003 | Jones |
| 2003/0222954 | A1 | 12/2003 | Jones et al. |
| 2003/0222955 | A1 | 12/2003 | Jones |
| 2004/0160498 | A1 | 8/2004 | Jones |
| 2004/0179074 | A1 | 9/2004 | Jones et al. |
| 2004/0183875 | A1 | 9/2004 | Jones et al. |
| 2005/0063820 | A1 | 3/2005 | Awdalla |
| 2005/0151814 | A1 | 7/2005 | Wong et al. |

* cited by examiner

TRANSPORT SYSTEM FOR SOLID INK FOR COOPERATION WITH MELT HEAD IN A PRINTER

1. REFERENCE TO RELATED APPLICATIONS

Cross reference is made to the following applications: 1776-0091 titled, "Transport System for Solid Ink in a Printer", having Ser. No. 11/602,943; 1776-0092 titled, "Printer Solid Ink Transport and Method", having Ser. No. 11/602,931; 1776-0093 titled "Guide For Printer Solid Ink Transport and Method", having Ser. No. 11/602,937; and 1776-0102 titled "Solid Ink Stick Features for Printer Ink Transport and Method",having Ser. No. 11/622,710; filed concurrently herewith which are incorporated herein by reference.

2. TECHNICAL FIELD

The system disclosed herein generally relates to high speed printers which have one or more print heads that receive molten ink heated from solid ink sticks or pellets. More specifically, the system relates to improving the ink transport system design and functionality.

3. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages solid ink sticks which remain in solid form at room temperatures. The ink stock can be refilled by a user by simply adding more ink as needed to the ink loader 110. Separate loader channels are used for the different colors. For example, only black solid ink is needed for monochrome printing, while solid ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates issues not satisfactorily addressed by the prior art solid ink printing architectures. To meet the large ink volume requirement, ink loaders must have large storage capacity and be able to be replenished by loading ink at any time the loader has capacity for additional ink In typical prior art solid ink loaders, the ink sticks are positioned end to end in a channel or chute with a melt device on one end and a spring biased push block on the other end. This configuration requires the operator to manually advance the ink in the chute to provide space to insert additional ink sticks, to the extent there is capacity in the channel.

The ink sticks are advanced end to end in the chute toward a melting station where a melting unit is used to melt the solid ink into a liquid form so that the liquid ink may form an image on a paper. After the image is formed, the paper is advanced by a drum to fuse the ink onto the paper.

The end of the lower most ink stick contacts the melting unit. The speed at which the ink is converted to a liquid affects the productive output of the printer. Improvements in the efficiency of melting the ink may improve the productivity of the printer.

4. SUMMARY

In view of the above-identified problems and limitations of the prior art and alternate ink and ink loader forms, a solid ink supply system is provided that is adapted for use with printers.

In one embodiment, an ink delivery system for use with a solid ink stick for use in printers is provided. The ink delivery system is used for receiving the stick and converting it to molten ink that may be transferred to media to form an image on the media. The delivery system includes a guide for receiving the stick and guiding the stick in a prescribed path and a melting unit. The melting unit is operably associated with the guide. The melting unit converts the stick to molten ink. The melting unit defines a receiving surface for receiving a first end of the stick. The receiving surface defines a plane. The guide defines a longitudinal axis of the guide adjacent the melting unit. The longitudinal axis defines an acute angle with respect to the plane.

In another embodiment, a printer including an ink delivery system for use with a solid ink stick is provided. The ink delivery system receives the stick and converts it to molten ink that may be transferred to media to form an image on the media. The printer includes a guide for receiving the stick and guiding the stick in a prescribed path and a melting unit. The melting unit is operably associated with the guide. The melting unit converts the stick to molten ink. The melting unit defines a receiving surface for receiving a first end of the stick. The receiving surface defines a plane. The guide defines a longitudinal axis of the guide adjacent the melting unit. The longitudinal axis forms an acute angle with respect to the plane.

In yet another embodiment, a method of converting solid ink sticks received into a printer to molten ink so that the ink may be transferred to media to form an image on the media is provided. The method includes the step of providing at least one solid ink stick defining a longitudinal axis of the stick and an external periphery of the stick. The method also includes the step of providing a melting unit for converting the stick to molten ink. The melting unit defines a receiving surface for receiving a first end of the stick. The receiving surface defines a plane. The method also includes the step of providing a guide for receiving the stick and guiding the stick in a prescribed path. The guide defines a longitudinal axis of the guide adjacent the melting unit. The method also includes the step of receiving the stick and guiding the stick in the prescribed path. The method also includes the steps of nudging the first end of the stick into contact with the receiving surface of the melting unit with the longitudinal axis of the stick defining an acute angle with respect to the plane of the receiving surface of the melting unit and melting the stick.

The ink delivery system for printers disclosed herein advances the ink from the loading station to the melting unit of the melting station where molten ink can be transferred to one or more print heads. The system uses a stick to melting unit angular orientation to improve the melting performance of the ink delivery system. The many additional described features of this ink delivery system, which can be selectively incorporated individually or in any combination, enable many additional printer system opportunities, including lower cost, enlarged ink storage capacity, as well as more robust feed reliability.

5. BRIEF DESCRIPTION OF THE DRAWINGS

Features of the described system will become apparent to those skilled in the art from the following description with reference to the drawings, in which.

6. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a print head are intended to encompass the range of intermediate connections, tubes, manifolds, heaters and/or other components that may be involved in a printing system but are not immediately significant to the system disclosed herein.

The general components of a solid ink printer have been described supra. The system disclosed herein includes a solid ink delivery system, and a solid ink printer and a method for incorporating the same.

Figure 1:
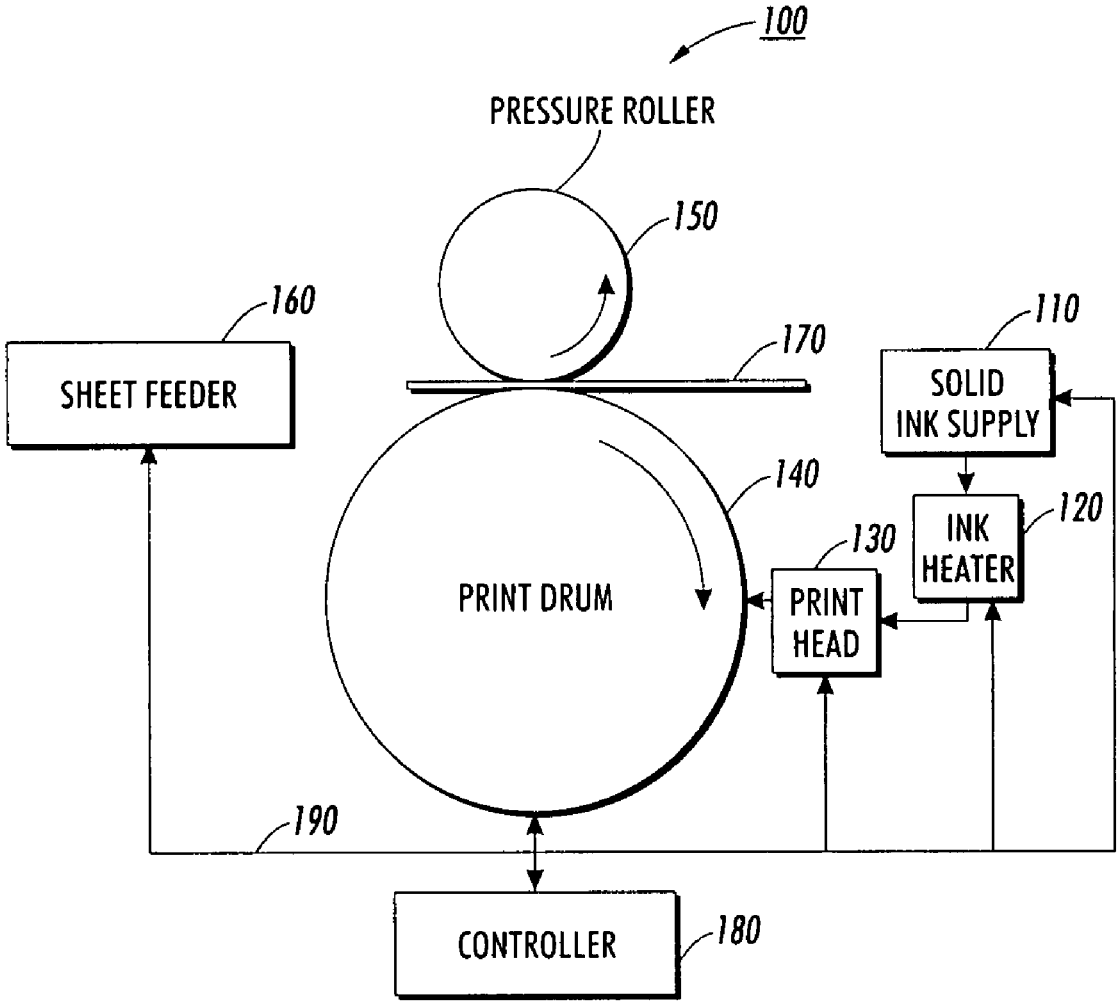
FIG. 1 PRIOR ART
FIG. 1 is a general schematic diagram of a prior art high speed, solid ink printer.
Figure 2:
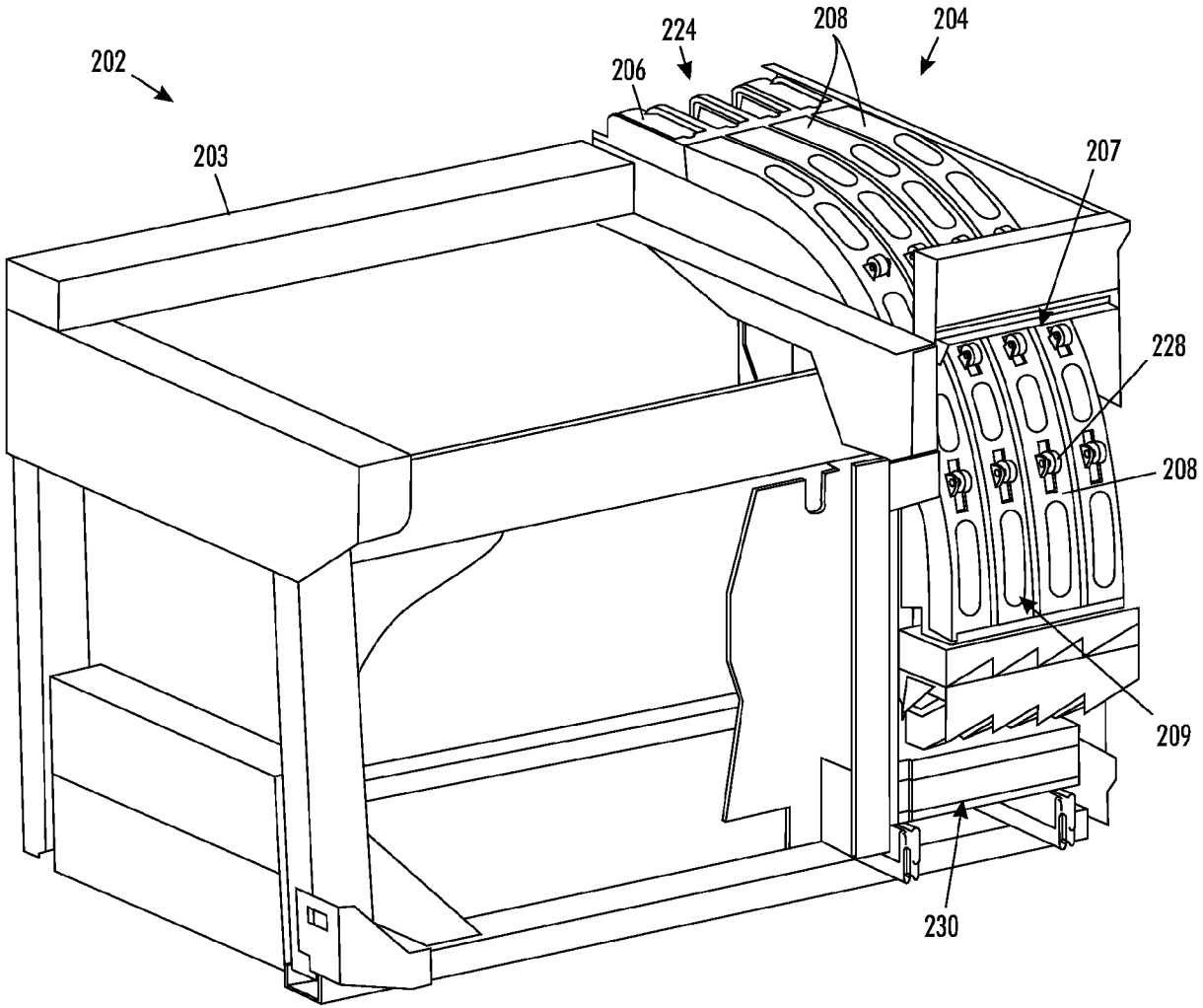
FIG. 2 is a partial cutaway perspective view of the solid ink delivery system in position in a solid ink printer for delivering solid ink sticks to printheads of the printer.

Referring now to FIG. 2, an embodiment of the solid ink printer with the solid ink delivery system is shown as solid ink printer 202. The printer 202 is a multi-color printer. The printer 202 utilizes four separate color ink sticks 206 which have respectively the colors black, cyan, magenta and yellow. The printer 202 of FIG. 2 also has a chute 208 that includes an arcuate portion 207. The arcuate portion may be comprised of a single or multiple arc axes, including continuously variable 3 dimensional arc paths, any combination of which can be of any length relative to the full arcuate portion. The term arcuate refers to these and any similar, non linear configuration. It should be appreciated that a solid ink color printer may be designed without a chute having an arcuate portion.

The printer 202, as shown in FIG. 2, has a frame 203 which is used to support ink delivery system 204. The ink delivery system 204 advances the sticks 206 from loading station 224 near the top of the printer 202 to melting station 230 near the bottom of the printer 202. The ink delivery system 204 incorporates four solid ink delivery sub-systems, each consisting, in part, of a load or receiving section, a feed chute and a melt unit. The printer 202 includes a plurality of chutes 208. The chutes 208 may be integral with each other or each of the plurality of chutes 208 may be a separate component. A separate chute 208 is utilized for each of the four colors: namely cyan, magenta, black and yellow. The chutes 208 are configured to contain and guide the sticks along the feed path from insertion to melt unit.

Figure 4:
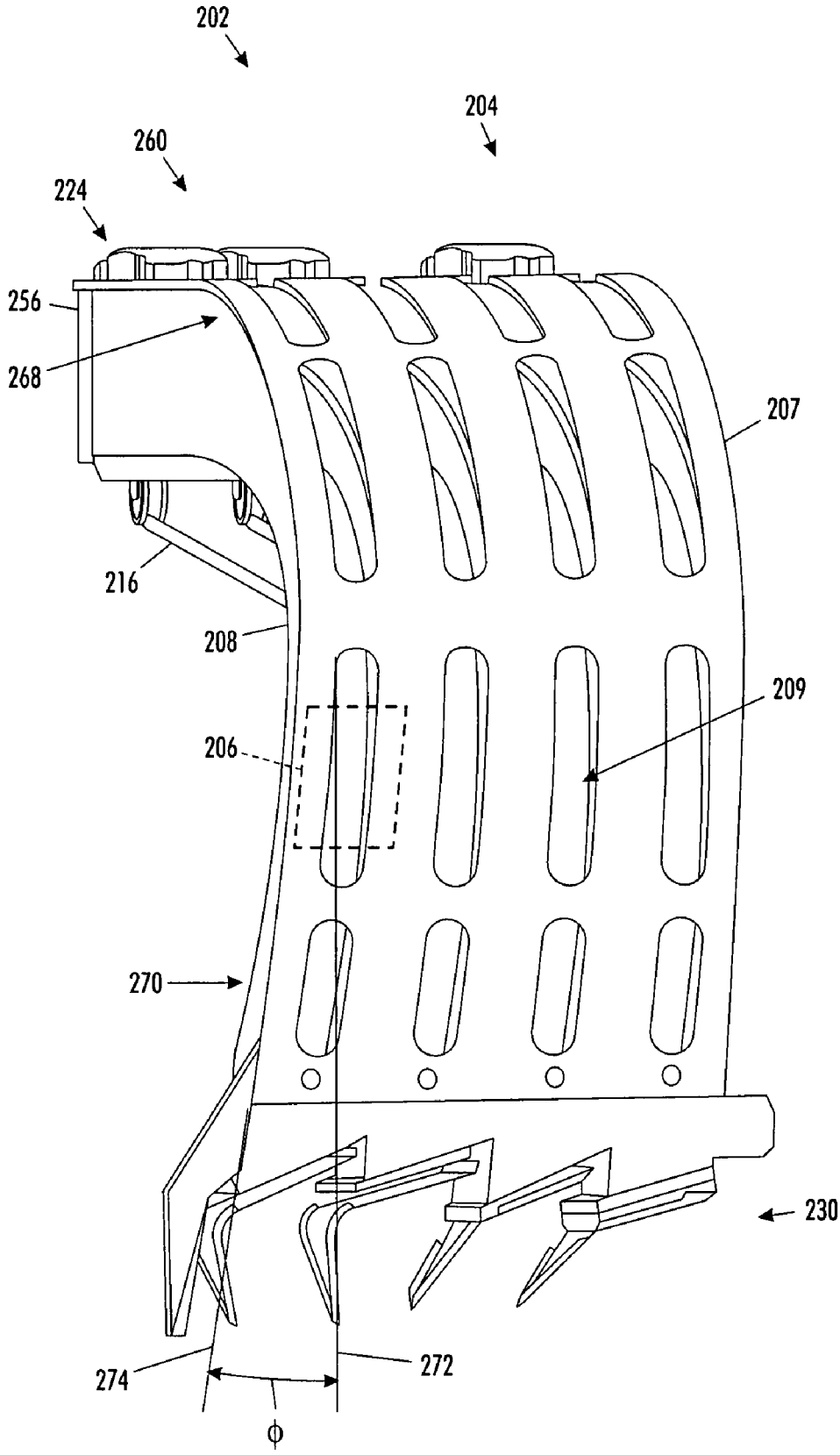
FIG. 4 is a perspective view of the guide for the ink sticks of the solid ink delivery system of FIG. 2 in position in a solid ink printer for delivering solid ink sticks to printheads of the printer.

As shown in FIG. 2, the chutes 208 may include longitudinal openings 209 for viewing the progress of the sticks 206 within the chutes 208 and also to reduce cost and weight. Nudging members 228 may be positioned along the chute 208 for nudging the sticks 206 into sufficient contact with belt 216 (FIG.4).

Figure 3:
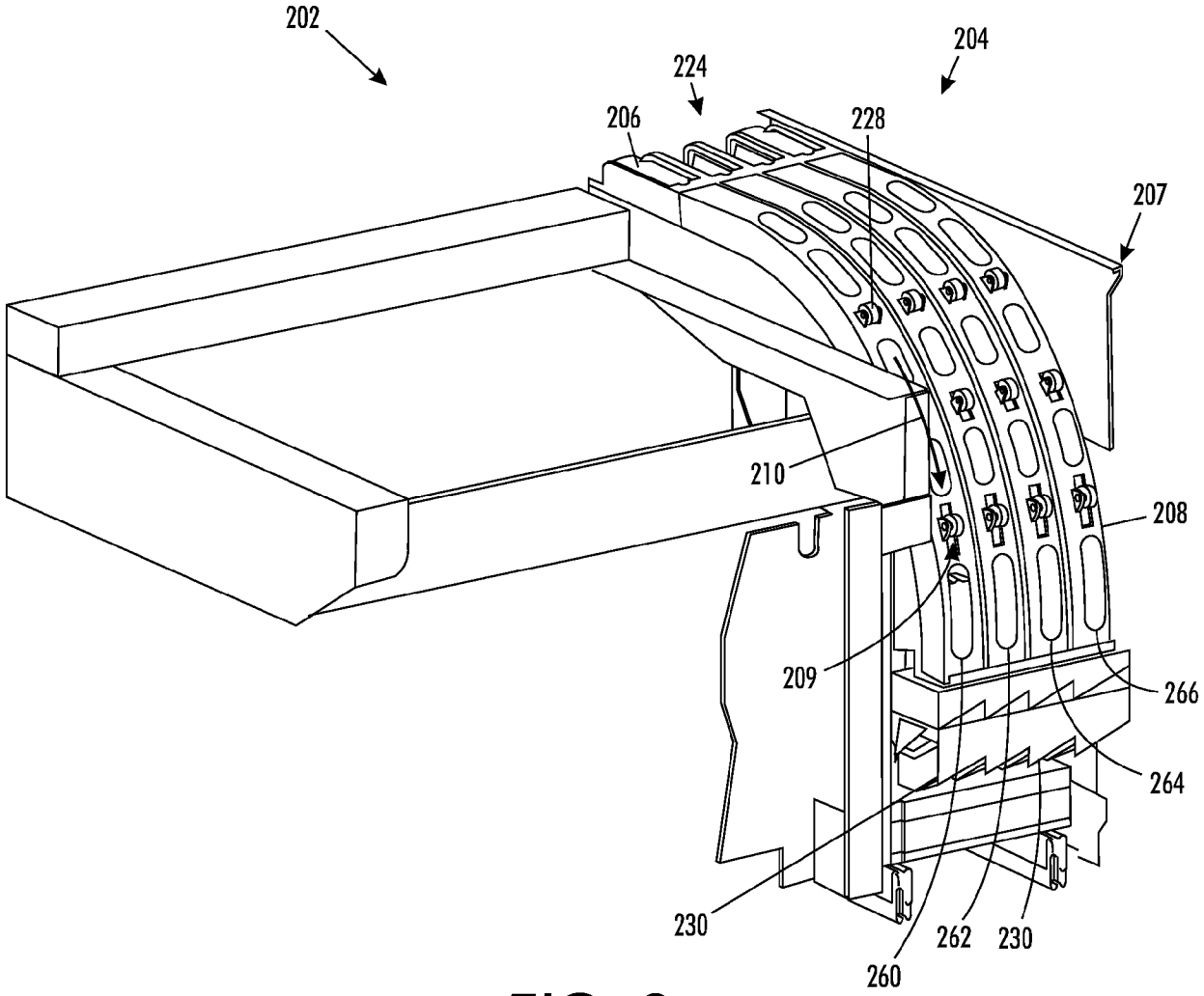
FIG. 3 is a partial cutaway perspective view of the solid ink delivery system of FIG. 2 in position in a solid ink printer for delivering solid ink sticks to print heads of the printer, showing the ink delivery system in greater detail.

Referring now to FIG. 3, the ink delivery system 204 of the printer 202 is shown in greater detail. The ink delivery system 204 includes four separate ink delivery sub-systems. The ink delivery system 204 incorporates four ink delivery sub-systems, each consisting, in part, of a load or receiving section, a feed chute and a melt unit. For example, the ink delivery system 204 includes a black ink delivery sub-system 260.

The ink delivery system 204 further includes a second, third and fourth ink delivery sub-system 262, 264 and 266 providing for cyan, yellow and magenta ink sticks respectively. The colors have been described in a specific sequence but may be sequenced in any order for a particular printer. Keyed insertion openings define which color will be admitted into a sub-system color chute of the ink delivery system 204.

Each of the ink delivery sub-systems 260, 262, 264 and 266 may be positioned parallel to each other and may have similar components. For simplicity, the black ink delivery sub-system 260 will be described in greater detail. It should be appreciated that the other sub-systems 262, 264 and 266 have similar components and operate similarly to the black ink delivery sub-system 260.

The black ink delivery sub-system 260 includes the guide in the form of chute 208 for holding a number of ink sticks 206 and advancing them in a prescribed path 210 from loading station 224 to the melting station 230. The chute 208 may have an insertion opening with any suitable shape such that only one color of an ink stick set may pass through the opening chute 208.

The black ink delivery sub-system 260 further includes a drive member in the form of belt 216 (FIG.4) which provides for engagement with a plurality of the sticks 206 and extends along a substantial portion of the prescribed path 210 of the ink delivery sub-system 260. The belt 216 engages more than one stick at a time. The belt 216 may simultaneously contact several sticks 206, each stick positioned at a different place in the chute.

While the chute 208 may have any suitable shape. For example, and as shown in FIG. 4, each chute 208 may include a first linear portion 268 adjacent the loading station 224. As shown in FIG. 4, the first linear portion 268 may be substantially horizontal such that the stick 206 may be inserted into the end 256 of the chute 208 in a simple motion in the top of the printer 202.

To better utilize the space within the printer 202, the chute 208 may have a shape that is not linear such that a greater number of sticks 206 may be placed within the printer 202 than the number possible with a linear chute. For example, and as shown in FIG. 4, the chute 208 may include, in addition to the first linear portion 268, arcuate portion 207 extending downwardly from the first linear portion 268 of the chute 208. The chute 208 may further include a second linear portion 270 extending downwardly from the arcuate portion 207 of the chute 208. The second linear portion 270 may be substantially vertical and be positioned over the melting station 230 such that the sticks 206 may be delivered to the melting station 230 by gravity.

The chute may lay within a single plane, for example, plane 272. Alternatively, and as shown in FIG. 4, the chute 208 may extend through a series of non-parallel planes. For example, and as shown in FIG. 4, the chute 208 may move downwardly and outwardly to an angled plane 274 which is skewed with respect to the vertical plane 272. The planes 272 and 274 form an angle $\phi$ there between. The angle $\phi$ may be any angle capable of providing for a larger number of sticks 206 in chute 208.

Figure 5:
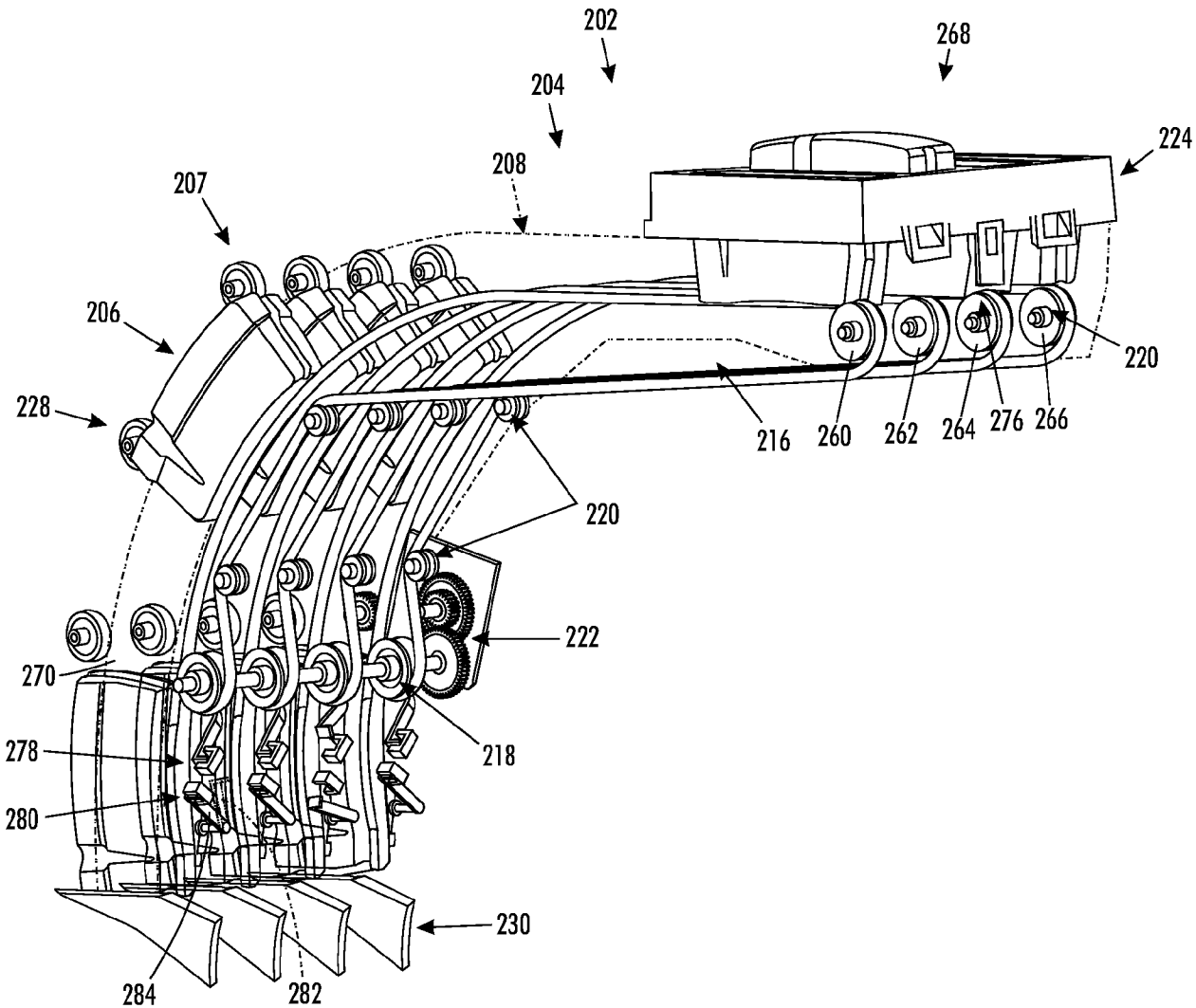
FIG. 5 is a perspective view of the guide assembly including the drive member for advancing the ink sticks of the solid ink delivery system of FIG. 2 toward the printheads of the printer.

Referring now to FIG. 5, the drive belt 216 of the ink delivery system 204 of the printer 202 is shown in greater detail. The drive belt 216 may require that a portion of the belt 216 contact the stick 206 over at least a portion of the ink stick travel range and have a shape to conform to the chute 208. The conforming shape may be in the arcuate portion 207 of the chute 208, as well as in the first linear portion 268 and the second linear portion 270 of the chute 208. The belt 216 may be driven, for example, by a motor transmission assembly 222 which is used to rotate drive pulley 218.

The drive belt 216 may, for example, have a circular cross section and be a continuous belt extending from the drive pulley 218 through at least one idler pulley 220 and chute 208. The progressive position of the drive pulley and idler pulley or pulleys relative to the belt travel direction can be in any order appropriate to chute and drive system configuration. Nudging members 228 in the form of, for example, pinch rollers may be spring loaded and biased against the belt 216 to assure sufficient friction between the belt 216 and the sticks 206 such that the sticks do not fall by gravity and slip away from the belt 216.

The belt 216 may have a constant diameter and may be sized to properly advance the sticks 206. The belt 216 may be made of any suitable, durable material. For example, the belt 216 may be made of a plastic or elastomer. If made of an elastomer, the belt 216 may be made of, for example, polyurethane.

The pulleys 218 and 220 have a similar size and shape and may include a pulley groove for receiving the belt 216. The pulley groove may be defined by a diameter similar to that of the diameter of the belt 216. The pulleys 218 and 220 are made of any suitable, durable material and may, for example, be of a plastic. If made of a plastic, for example, the pulley may be made of Acetyl or of a glass reinforced nylon.

In order that the ink sticks 206 be able to slide smoothly along the chute 208, potential contact surfaces of the chute 208 should be made of a material that provides a coefficient of friction between the internal periphery of the chute 208 and the external periphery of the sticks 206 that is low enough to permit the easy flow or movement of the sticks 206 in the chute 208. Conversely, the coefficient of friction between the internal periphery of the chute 208 and the belt 216 should be sufficiently low to permit the advancement of the belt 216 within the chute 208. The coefficient of friction between the belt 216 and the sticks 206 should be sufficiently high to cause the belt 216 to engage the sticks 206 and to cause the belt 216 to properly advance the sticks 206 along the chute 208. Friction values are not definite and will vary based on numerous factors of a given system, such as stick size, stick to stick interfaces, angle of travel relative to gravity and so forth.

The ink delivery system 204 of the printer 202 may further include a series of indicators or sensors for determining the presence or absence of the sticks 206 within different portions of the chute 208. An inlet sensor assembly 276 may be used to indicate additional ink sticks 206 may be added to the chute 208. The inlet sensor assembly 276 may be positioned near loading station 224. A low sensor assembly 278 may be used to indicate a low quantity of ink sticks 206 in the chute 208. The low sensor assembly 278 may be positioned spaced from the melt station 230.

An out sensor assembly 280 may be used to indicate the absence of ink sticks 206 in the chute 208. The out sensor assembly 280 may be positioned adjacent to the melt station 230. The sensor assemblies 276, 278 and 280 may have any suitable shape and may, for example, and as is shown in FIG. 5, be in the form of pivoting flags or sensors that pivot about a wall of the chute 208. The presence of a stick 206 causes the sensors to move from first position 282, as shown in phantom, to second position 284, as shown in solid. A sensor or switch may be used to determine whether the sensors 276, 278 or 280 are in the first position 282 or in the second position 284. Other sensing devices may be used in conjunction with or in place of a mechanical flag system, such as a proximity switch or a reflective or retro-reflective optical sensor.

Figure 6:
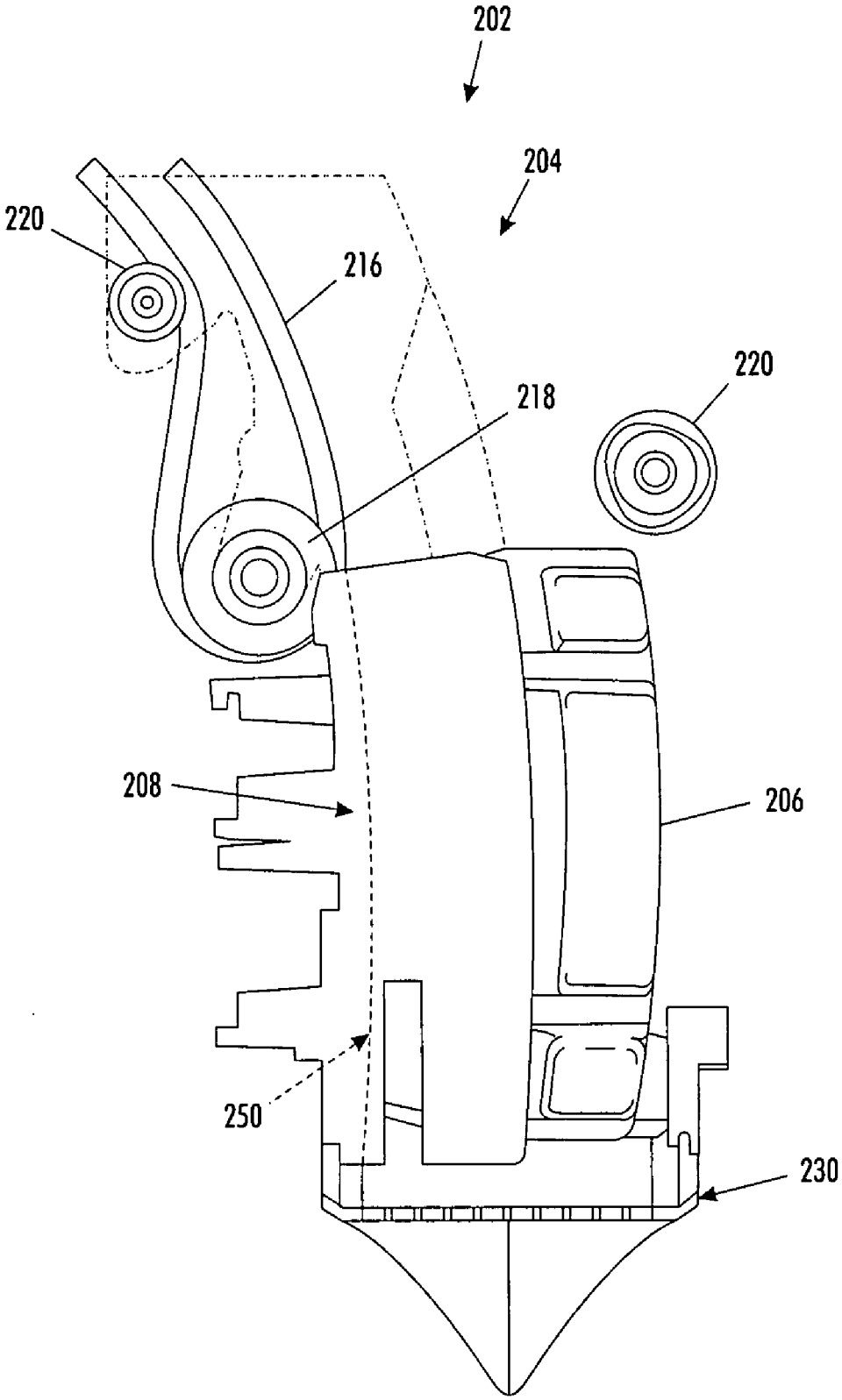
FIG. 6 is partial perspective view of the guide assembly including the drive member for advancing the ink sticks of the solid ink delivery system of FIG. 2 showing the portion adjacent the print heads in greater detail.

Referring now to FIG. 6, the ink delivery system 204 of the printer 202 is shown in the location around the melt station 230. As shown in FIG. 6, the drive pulley 218 and the belt 216 are positioned somewhat away from an ink stick 206 when the stick 206 is in the melt station 230. The spacing of the belt 216 away from the stick 206 when the stick 206 is in the melt station 230 may permit gravity to be the only factor causing the sticks 206 to be forced against a melt unit when the belt is stopped. If the belt 216 continues to run, however, additional sticks 206, if present, may contact the belt 216 and push against the lower stick 206, nudging it toward the melt station 230.

It should be appreciated that, alternatively, the pulley 218 may be positioned low enough that the stick 206 may be in contact with the pulley 218 when the stick 206 is in the melt station 230. With such a configuration, the belt 216 may ensure sufficient forces are exerted on the stick 206 to increase the contact pressure of the stick 206 against the melt unit.

Figure 7:
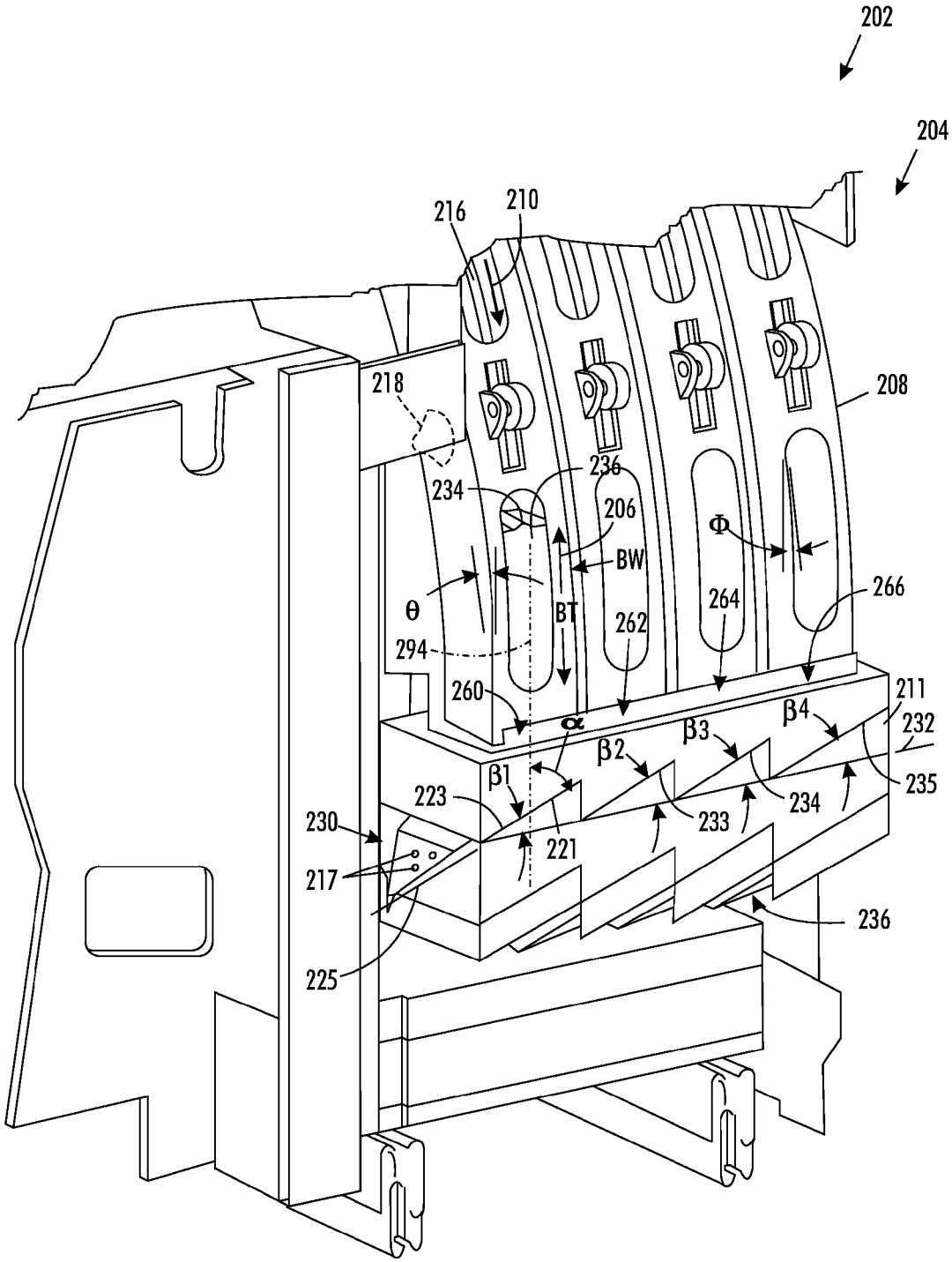
FIG. 7 is a partial perspective view of the guide assembly of FIG. 6.

Referring now to FIG. 7, the ink delivery system 204 is shown in greater detail. The ink deliver system 204 is utilized in, for example, printer 202. The ink delivery system 204 is utilized for receiving the stick, for example, a rectangular stick 206 and converting it to molten ink 217. The molten ink 217 may be transferred to media to form an image on the media.

The ink delivery system 204 as shown in FIG. 7 includes a guide, for example, the guide 208 in the form of a chute for guiding the sticks 206 toward the melting station 230. The guide or chute 208 guides the sticks 206 in a prescribed path 210. The ink delivery system 204 further includes a melting unit 211 which is operably associated with the guide or chute 208. The melting unit 211 converts the stick 206 to molten ink 217. The melting unit 211 defines a receiving surface 221

The receiving surface 221 of the melting unit 211 receives a lower or first end 223 of the stick 206. It should be appreciated that the receiving surface 221 contacts the first end 223 of the stick 206. To optimize the melting of the stick 206, the receiving surface 221 is preferably optimized such that the optimum receiving surface 221 contacts the first end 223 of the stick 206. The receiving surface 221 may have any suitable shape. The receiving surface 221 may be flat or planer or the receiving surface 221 may be undulating or not flat. The receiving surface 221 may be arcuate.

The receiving surface 221 may be defined by a plane, for example, plane 225. The plane 225 may be centrally positioned with respect to the surface 221 for simulating the receiving surface 221. It should be appreciated that if the receiving surface 221 is planer, the plane 225 is coexistent with the receiving surface 221. The stick 206 defines a longitudinal axis 294 of the stick 206. It should be appreciated that to minimize the receiving surface 221 contact with first end 223 of the stick 206, the longitudinal center line 294 of the stick 206 may be perpendicular or normal to the plane 225. It should also be appreciated that as the longitudinal center line 294 of the stick 206 deviates more and more from normal with respect to the receiving surface 221 of the melting unit 211, the contact surface of the first end 223 of the stick 206 against the receiving surface 221 may increasingly enlarge.

The Applicants have found that if the angle between the center line 294 of the stick 206 and the receiving surface 221 is permitted to be other than normal, a greater contact with the stick 206 may be accomplished and correspondingly an increase in the melting of the stick 206 may occur.

As shown in FIG. 7, the stick 206, as it approaches the melting station 230, is oriented such that center line 294 of the stick 206 is not perfectly aligned vertically. For example and as shown in FIG. 7, the width of the chute 208 is oriented such that the chute 208 forms an angle Φ with respect to the vertical in the horizontal or X direction.

Similarly in the depth or Z direction, the stick 206 forms an angle θ with respect to the vertical. It should be appreciated as is shown in FIG. 7, that the angles Φ and θ maybe quite small. In fact, the angle θ may approach zero depending on the angular orientation of the chute 208. Similarly, the angle Φ may be quite small, as is shown in FIG. 7.

The melting unit 211 includes a receiving surface, for example, the black receiving surface 221 which is at an angle β1 with respect to the horizontal plane 232. The angle β1 is chosen to optimize the conversion of the stick 206 to molten ink 217. It should be appreciated the angle β1 is experimentally optimized and may, as is shown in FIG. 7, be less than 90°, for example, approximately 15° to 60° or 25° to 45°.

The ink delivery system 204, as shown in FIG. 7, may be an ink delivery system for a color printer. If the ink delivery system 204 is for a color printer, the ink delivery system 204 includes the black solid ink delivery system 260, the cyan ink delivery system 262, the yellow ink delivery system 264, and the magenta ink delivery system 266.

The cyan ink delivery system 262 includes a cyan receiving surface 233 which forms an angle β2 with respect to horizontal plane 232. Similarly, the yellow ink delivery system 264 includes a yellow receiving surface 234 which forms an angle β3 with respect to the horizontal plane 232. Similarly, the magenta ink delivery system 266 includes a magenta receiving surface 235 which forms an angle β4 with respect to the horizontal plane 232.

Figure 7A:
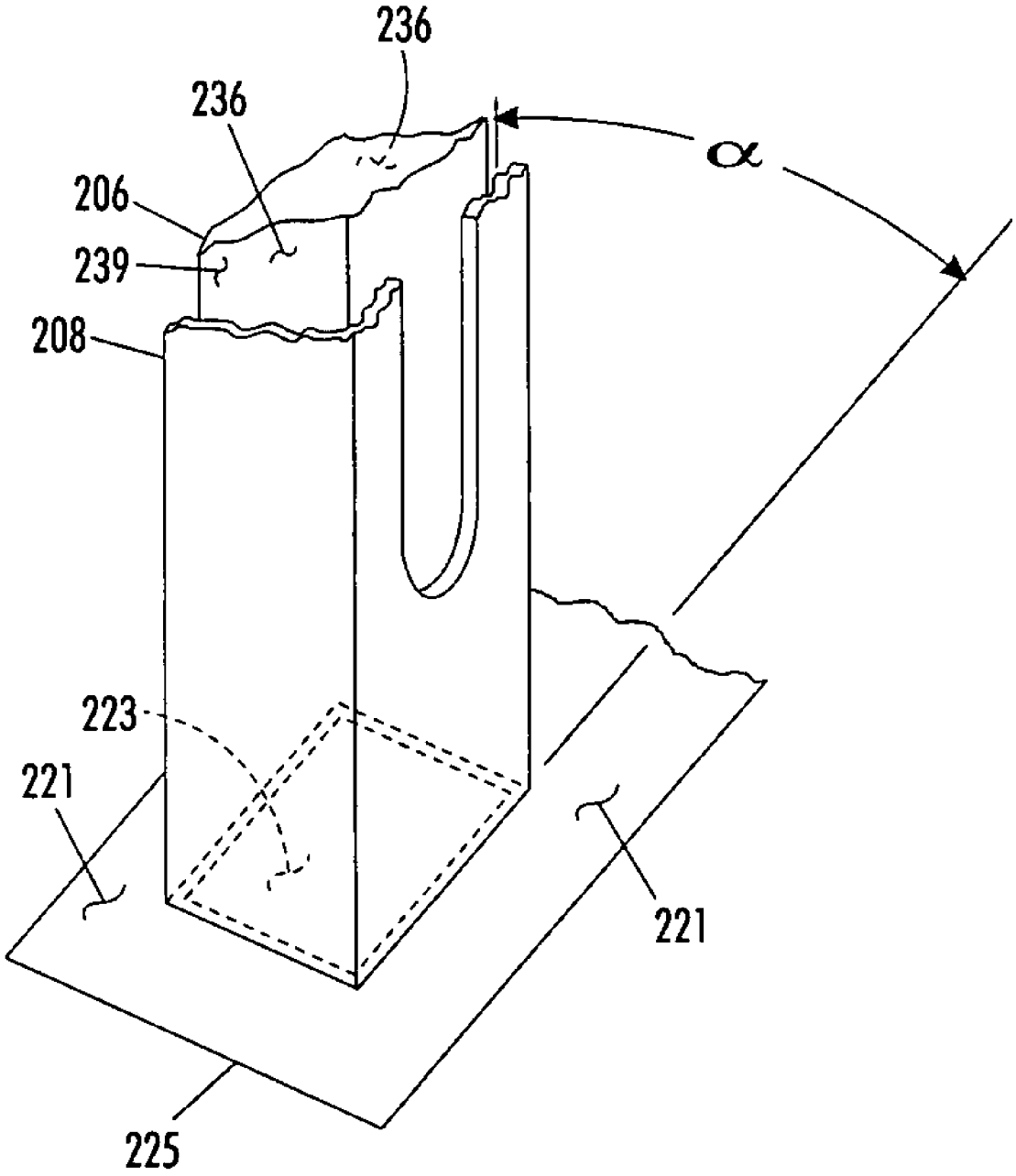
FIG. 7A is a partial perspective view of the chute of the solid ink delivery system of FIG. 7 showing the chute adjacent the melting units in greater detail.

The stick 206, as shown in FIG. 7A, represents a black stick. It should be appreciated that a similar stick may be utilized for the cyan ink deliver system 262, the yellow ink delivery system 264, and the magenta ink delivery system 266.

The stick 206 defines opposed parallel surfaces 236. One of the opposed parallel surfaces 236 defines a stick surface plane 239. The stick surface plane 239 and the melting area plane 221 define an included acute angle α positioned between them.

Figure 7B:
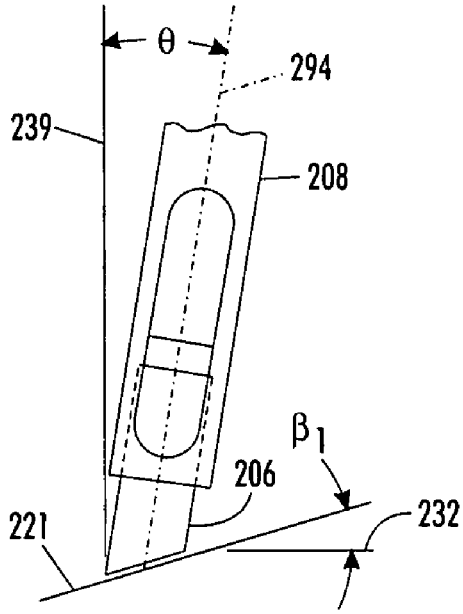
FIG. 7B is a partial plan view of the chute of the solid ink delivery system of FIG. 7 showing the front of the chute adjacent the melting units in greater detail.

Referring now to FIG. 7B, a partial view of the front of the chute 208 showing the horizontal or X axis is shown with the stick 206 in position in the chute 208. The longitudinal center line 294 of the stick 206 forms the angle θ with respect to vertical axis 239 in the X direction. The receiving surface 221 of the melting unit forms the angle β1 with respect to horizontal plane 232.

Figure 7C:
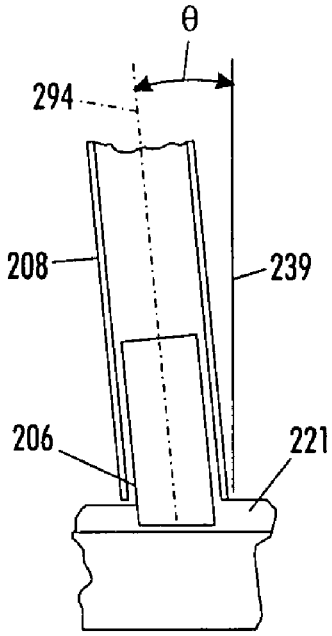
FIG. 7C is a partial plan view of the chute of the solid ink delivery system of FIG. 7 showing the side of the chute adjacent the melting units in greater detail.

Referring now to FIG. 7C, a partial view of the front of the chute 208 showing the depth or Z axis is shown with the stick 206 in position in the chute 208. The longitudinal center line 294 of the stick 206 forms the angle θ with respect to vertical axis 239 in the Z direction.

Referring again to FIG. 7, the black ink from black solid ink delivery subsystem 260 after being melted moves to the black portion of liquid reservoir 236. Similarly, liquid cyan ink leaves from the cyan solid ink delivery subsystem 262 to the respective liquid reservoir 236. Similarly, yellow molten ink from the yellow solid ink deliver subsystem 264 is delivered to liquid reservoir 236. Also, molten magenta ink flows from the magenta solid ink delivery subsystem 266 to liquid reservoir 236. The respective inks, the black ink, the magenta ink, the cyan ink, and the yellow ink from the liquid reservoir 236, are advanced through the printer to form the image on the paper.

Figure 8:
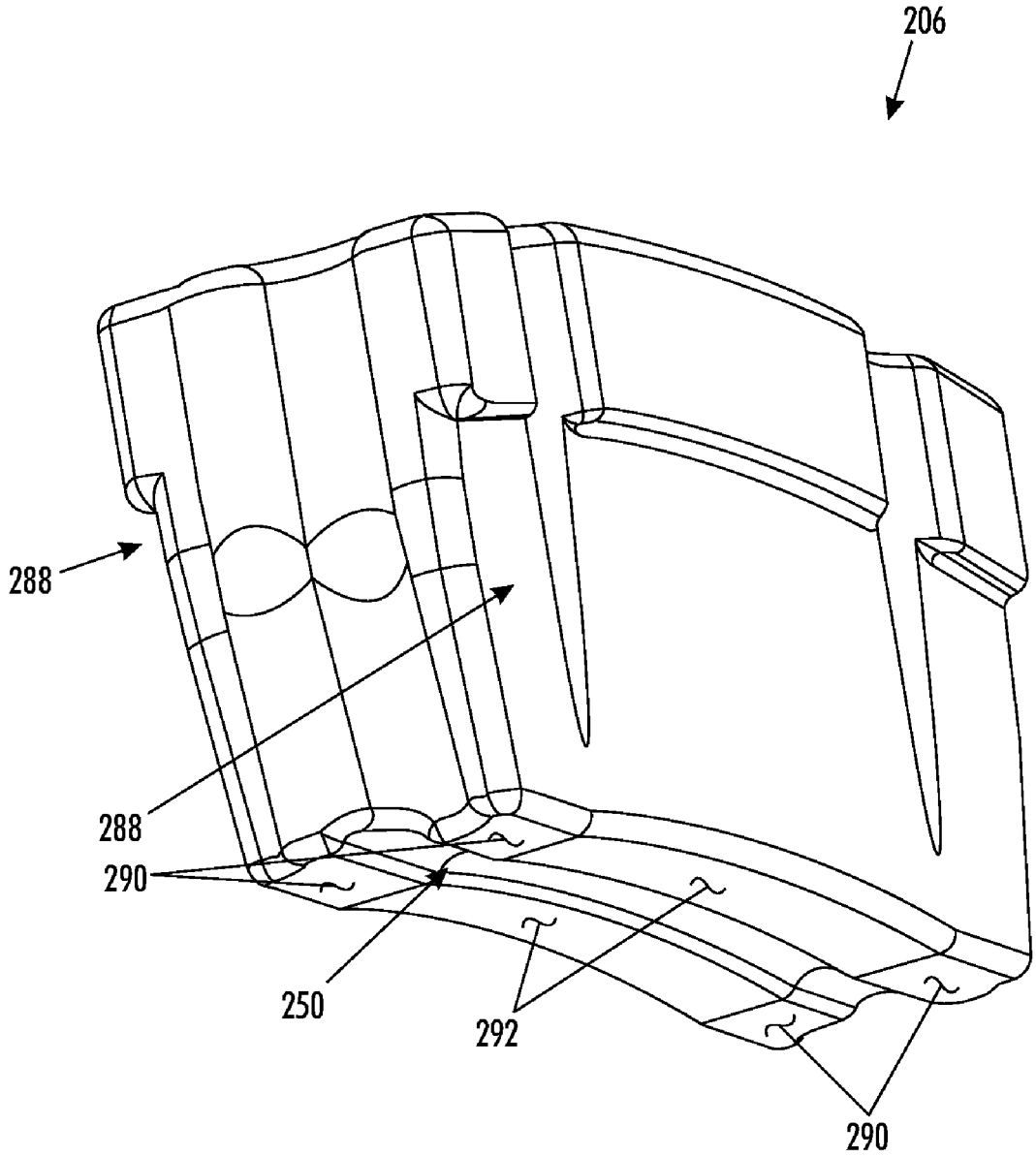
FIG. 8 is a perspective view of a solid ink stick for use with the guide assembly for advancing the ink sticks of the solid ink delivery system of FIG. 7 toward the print heads of the printer.

Referring now to FIG. 8, stick 206 for use with the printer 202 of FIGS. 2-5 is shown in greater detail. The stick 206, as is shown in FIG. 8, includes a series of vertical keying features used, among other things, to differentiate sticks of different colors and different printer models. The stick keying features are used to admit or block insertion of the ink through the keyed insertion opening of the ink delivery system 204. The stick 206 further includes a series of horizontal shaped features 288 for guiding, supporting or limiting feed of the ink stick 206 along the chute 208 feed path. It should be appreciated that keying and shaped features can be configured to accomplish the same functions with a horizontal or other alternate loading orientation.

Openings may be formed in a secondary component affixed to the chute and may employ size, shape and keying features exclusively or in concert with features of the chute to admit or exclude ink shapes appropriately. For convenience, the insertion and keying function in general will be described as integral to the chute 208.

The solid ink stick 206, as shown in FIG. 8, includes two spaced-apart pairs of spaced-apart flat portions 290, one pair on each end of the stick 206, for accommodating the linear portions of the ink feed path, as well as a centrally located pair of spaced apart arcuate portions 292, to accommodate the curved or arcuate portion of solid ink prescribed path 210. Ink stick groove 250 likewise has linear and arcuate portions.

Figure 9:
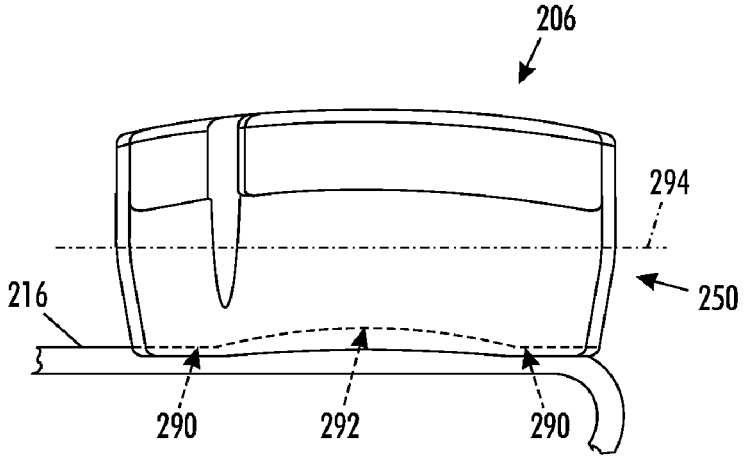
FIG. 9 is a plan view of the solid ink stick of FIG. 8 in position on a flat portion of the drive member of the guide assembly FIG. 6.

Referring now to FIG. 9, the solid ink stick 206 is shown in position on a linear portion of the belt 216 of the ink delivery system 204 of the printer 202. The stick 206 contacts the belt 216 at the end portions 290 of the stick 206 and the groove 250 formed in the stick 206 cooperates with the belt 216 to advance the stick 206. As shown in FIG. 9, the stick 206 is arcuate or curved along longitudinal axis 294.

Figure 10:
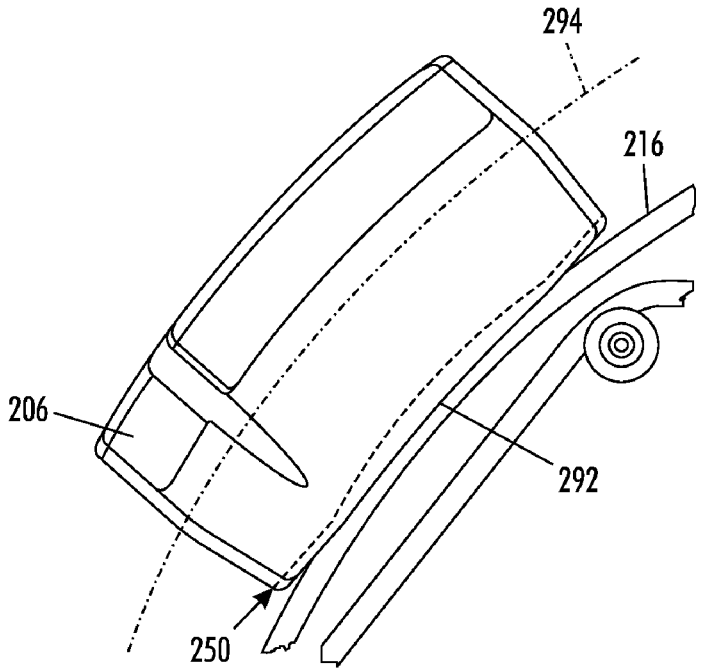
FIG. 10 is an plan view of the solid ink stick of FIG. 8 in position on a curved portion of the drive member of the guide assembly FIG. 6.

Referring to FIGS. 9 and 10, the stick 206 is shown in position along an arcuate portion of the belt 216. As shown in FIG. 10, the central arcuate portion 292 of the solid in stick 206 engages with the belt 216.

Figure 11:
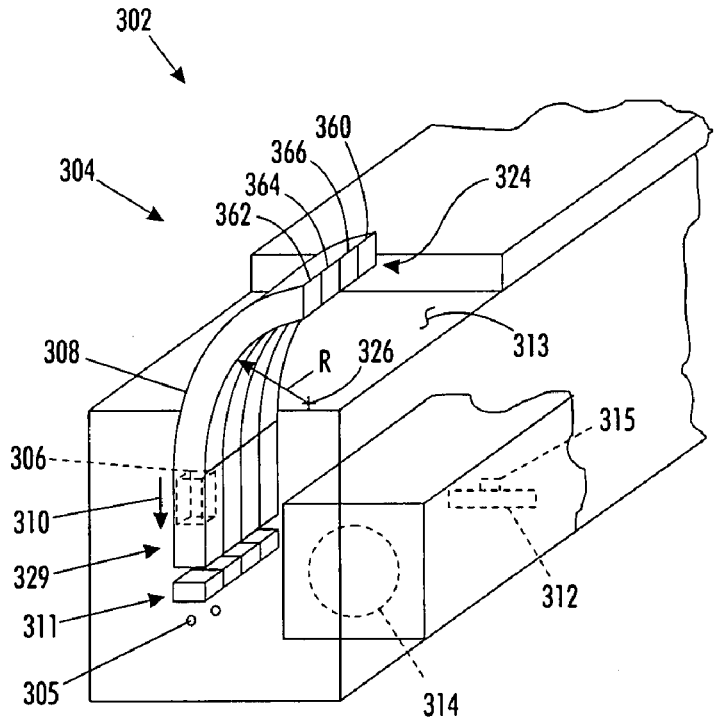
FIG. 11 is a partial perspective view of an embodiment of a solid ink delivery system for delivering solid ink stock to a melting station for converting the solid ink into liquid form for delivery to print heads of the printer.
Figure 12:
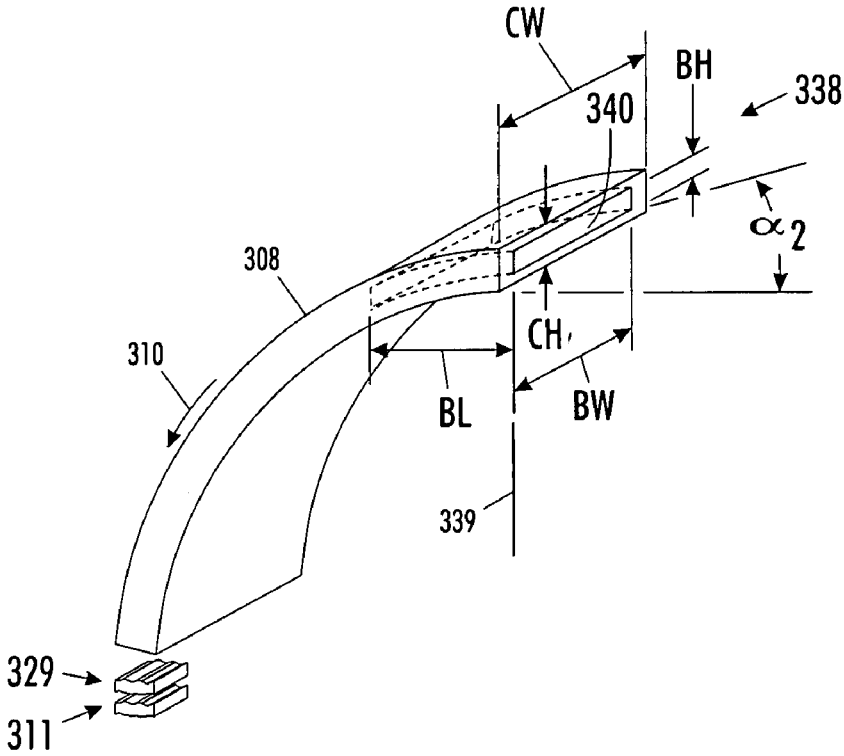
FIG. 12 is a partial perspective view of the chute of the solid ink delivery system of FIG. 11.

Referring now to FIGS. 11 and 12, another embodiment is shown as solid ink printer 302. The printer 302 includes an ink delivery system 304 for delivering a solid ink stick 306 to a melting station, where a melting unit 311 is used to melt the stick 306. The ink in the stick 306 is transferred from a solid to a liquid and the liquid ink 305 is transferred to media, for example, a sheet of paper 312, by a drum 314 to form an image 315 on the paper 312. The ink delivery system 304 includes a guide for guiding the stick 306 in a prescribed path 310. The guide may be, for example, in the form of a guide or chute 308. The chute 308 defines a loading station 324 to permit the stick 306 to be placed into the guide or chute 308. The chute 308 is configured to contain and guide the sticks along the feed path from insertion to melt unit 311.

The chute 308 also defines a delivery station 329 adjacent to the melting unit 311. The loading station 324 is located above the delivery station 329. The stick 306 is slideably fitted to the chute 308 where by only gravity advances the stick 306 from the loading station 324 to the delivery station 329.

It should be appreciated that the chute 308 may have any suitable shape such that the sticks 306 fall by gravity from loading station 324, that may be positioned near, for example, the printer top work surface 313, toward the melting unit 311. The chute 308 may be linear or arcuate. The arcuate portion may be comprised of a single or multiple arc axes, including continuously variable 3 dimensional arc paths, any combination of which can be of any length relative to the full arcuate portion. The term arcuate refers to these and any similar, non linear configuration. For example the chute 308 may, as is shown in FIG. 11, be of a continuous arcuate shape defined by a radius R extending from the origin 326. It should be appreciated that origin 326 may be positioned anywhere with respect to the chute 308 and that the radius R may be constant, or, as is shown in FIG. 11, vary such that the radius R may increase such that the chute is virtually vertical near the melting unit 311.

The chute configuration examples shown in the various alternative embodiments are depicted as fully matching the ink shape at least in one sectional axis. The chute need not match the ink shape in this fashion and need not be completely encircling. One or more sides may be fully or partially open or differently shaped. The side surfaces of the chute do not need to be continuous over the chute length. The chute need only provide an appropriate level of support and/or guidance to complement reliable loading and feeding of ink sticks intended for use in any configuration.

Referring now to FIG. 12, it should be appreciated that the chute 308 forms a stick opening 338 in a suitable size and shape to provide for the uniform movement of the sticks 306 down the chute 308 along the path 310. To avoid cross loading or jamming of the sticks 306 in the chute 308, the sticks 306 may have an external periphery which closely conforms with the internal periphery formed in the stick opening 338 of the chute 308.

For example, and as is shown in FIG. 12, the sticks 306 may be rectangular and the stick opening 338 of the chute 308 may be rectangular and slightly larger than the sticks 306 to provide the ability of the sticks 306 to fall by gravity down the chute 308.

For example, and as shown in FIG. 12, the sticks have a stick length BL, a stick height BH, and a stick width BW. The stick opening 338 of the chute 308 may be defined by a chute height CH slightly larger than the stick height BH and a chute width CW slightly wider than the stick width BW.

Further to assure that the sticks 306 fall by gravity down the opening 338 of the chute 308 and as is shown in FIG. 12, the bottom surface 340 of the chute opening 338 may form an angle $\alpha 2$ with the horizontal plane such that the force of gravity may exceed the coefficient of friction between the sticks 306 and the bottom surface 340 such that the sticks advance along the path 310 from the loading station 324 to the delivery station 329. Friction values are not definite and will vary based on numerous factors of a given system, such as stick size, stick to stick interfaces, angle of travel relative to gravity and so forth. A lubricious tape or similar non-stick surface may be applied to the bottom surface 340 to minimize friction.

Referring again to FIG. 11, the printer 302 is a color ink printer. The chute 308, as shown in FIG. 10, include a first black chute 360, a second cyan ink chute 362, a third magenta ink chute 366, and a fourth yellow ink chute 364. The four ink chutes 360, 362, 364 and 366 may each have their respective keys to provide for the entry of only the proper ink stick. The colors have been described in a specific sequence but may be sequenced in any order for a particular printer. Keyed insertion openings define which color will be admitted into a particular color chute of the chute 308. It should be appreciated that the printer disclosed herein may be a black or monochrome printer having a solitary chute with gravity feed.

Figure 12A:
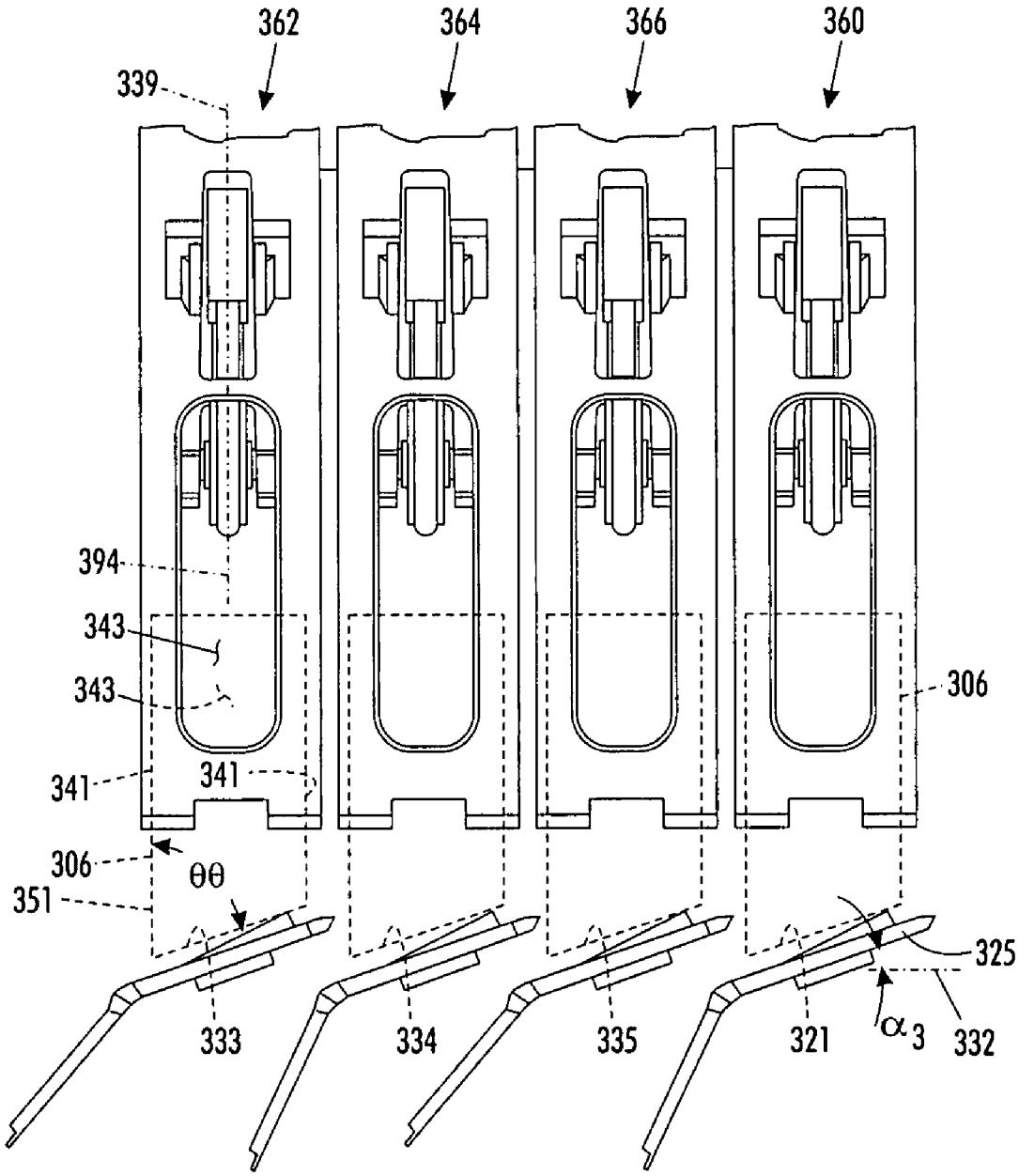
FIG. 12A is a partial plan view of the chute of the solid ink delivery system of FIG. 11 showing the chute adjacent the melting units in greater detail.

Referring now to FIG. 11, 12, and 12A, another embodiment is shown as solid ink delivery system 304 for use in, for example, printer 302. The solid ink delivery system 304 is similar to the solid ink delivery system 204 of the printer 202 of FIGS. 2-10 except that the printer 302 includes the solid ink delivery system 304 which relies on gravity to advance ink sticks 306 to the melting unit 311. The solid ink delivery system 304 includes a melting unit 311 that forms an angle, for example acute angle $\alpha 2$ with respect to horizontal plane 332. The chute 306 as shown in FIGS. 11 and 12 is arcuate, or curved. The sticks 306 advance to melting station 311.

As shown in FIGS. 12 and 12A, the chutes 306 are arcuate, but provide a generally vertical position for the sticks 306 adjacent the delivery station 329. The stick 306 defines a stick longitudinal axis 394 which, as is shown in FIG. 12A, is coincident with vertical axis 339. Thus, as shown in FIG. 12A, the stick 306 is positioned generally vertical in the chute 306 adjacent the melting unit 311. As shown in FIG. 12A, the melting units 311 include a receiving surface which defines a plane 325.

The plane 325, as is shown in FIG. 12A, forms an angle $\alpha 3$ with respect to horizontal plane 332. The angle $\alpha 3$ is chosen to optimize the melting rate of the sticks 306. As shown in FIG. 12A, the black ink delivery subsystem 360 includes a receiving surface 321 which is along plane 325. Similarly, the magenta ink delivery subsystem 366 includes a receiving plane 335 which is positioned along plane 325. Yellow ink delivery subsystem 364 includes receiving surface 334 also positioned along plane 325. The cyan ink delivery subsystem 362 mates with receiving surface 333 of the melting unit 311, which is positioned along plane 325.

As shown in FIG. 12A, the ink delivery system 304 of the printer 302 of FIGS. 11, 12, and 12A include sticks in the form of sticks 306 that define opposed parallel surfaces 341, defining a first stick surface plane 351. The first stick surface plane 351 and the melting area plane 325 define an acute angle $\theta\theta$ there between.

The stick 306 further defines a second set of opposed parallel surfaces 343 which are normal to the first set 341 of opposed parallel surfaces of the stick 306. One surface of the second set 343 of opposed parallel surfaces define a second stick surface plane 345. The second stick surface plane 345 and the melting area plane 325 define a right angle there between.

Figure 13:
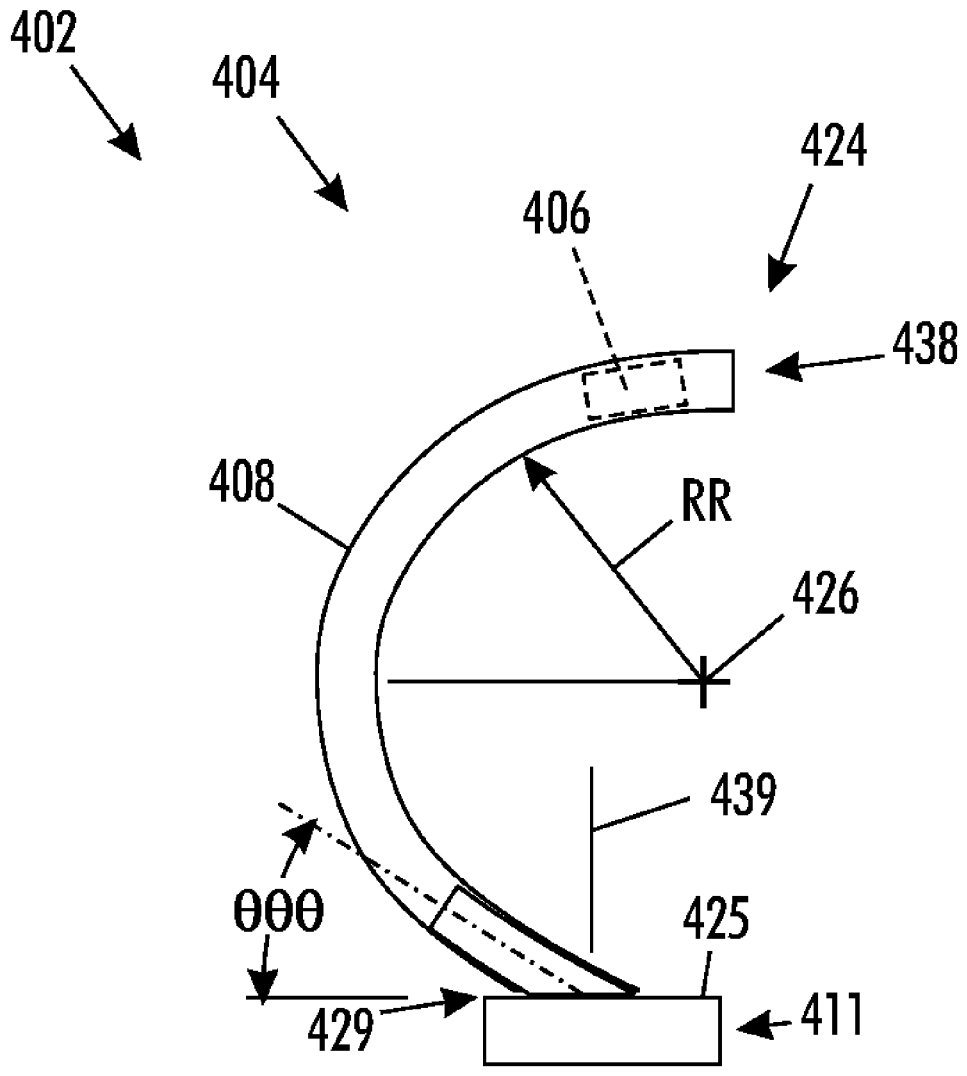
FIG. 13 is a partial plan view of another embodiment of the solid ink delivery system with a chute that has a portion that extends underneath another portion of the chute.
Figure 14:
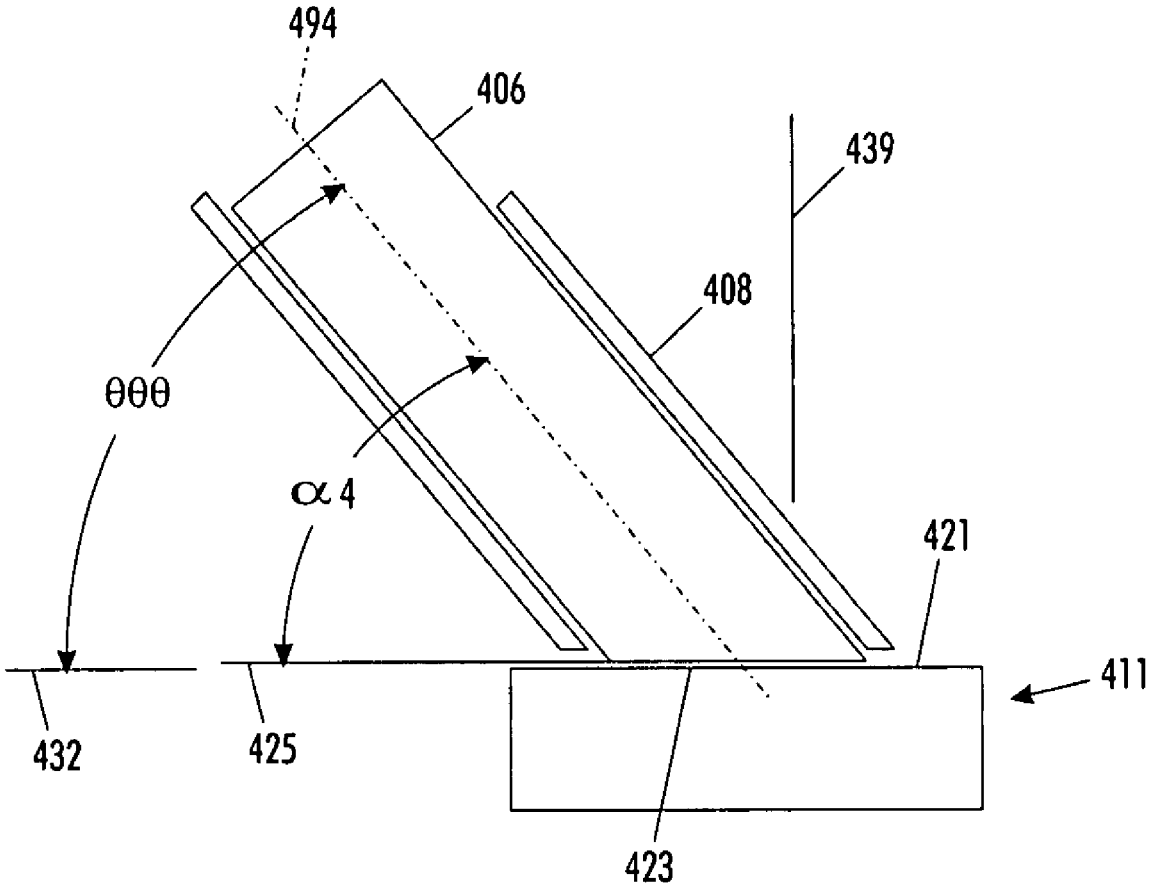
FIG. 14 is a partial plan view of the delivery system of FIG. 13.

Referring now to FIGS. 13 and 14, another embodiment is shown as ink printer 402 which includes solid ink delivery ink system 404 for delivering sticks 406 that is somewhat different than the ink delivery system 204 of the ink printer 402 of FIGS. 2-6. The ink delivery system 404 of FIG. 13 includes a chute 408 which is different than the chute 408 of the ink delivery system 204 of FIGS. 2-4. The chute 408 is similarly an arcuate chute and is defined by radius RR extending from origin 426. The radius RR may be constant or may vary, for example, increase.

The chute 408, as shown in FIG. 13, has a path that crosses over itself, or in other words the upper portions of the chute 408 may be positioned over the lower portions of chute 408. Such a chute configuration as chute 408 may conserve space. It should be appreciated that the chute 408 may lie in a single plane or in a plurality of non-parallel planes. In other words, the chute 408 may form, for example, a spiral shape or a helical shape.

The chute 408 may have any size and shape and opening 438 of the chute 408 may, for example, be rectangular, triangular, pentagonal, or have any other shape. The size and shape of the opening 438 of the chute 408 is preferably similar to the size and shape of the stick 406 to be positioned in the chute 408 so that the sticks 406 may freely fall by gravity down the chute 408 from the loading station 424 to delivery station 429 adjacent melting units 411.

Referring now to FIG. 14, the ink delivery system 404 includes a chute 408 that has a position of the chute 408 at the delivery station 429 which forms an angle θθθ with respect to horizontal plane 432. The solid ink sticks 406 define a first end 423 which defines a plane 425 with respect to receiving surface 421 of the melting unit 411. The plane 425 defined by the receiving surface 421 forms an angle α4 with respect to longitudinal axis 494 of the stick 406. The receiving surface 421 may as shown be perpendicular to vertical axis 439. The angle α4 is selected to optimize the melting of the solid ink stick 406 by the melting units 411. The angle α4 may be different from the angle θθθ, with the plane 425 being skewed with respect to the horizontal plane 432.

Figure 15:
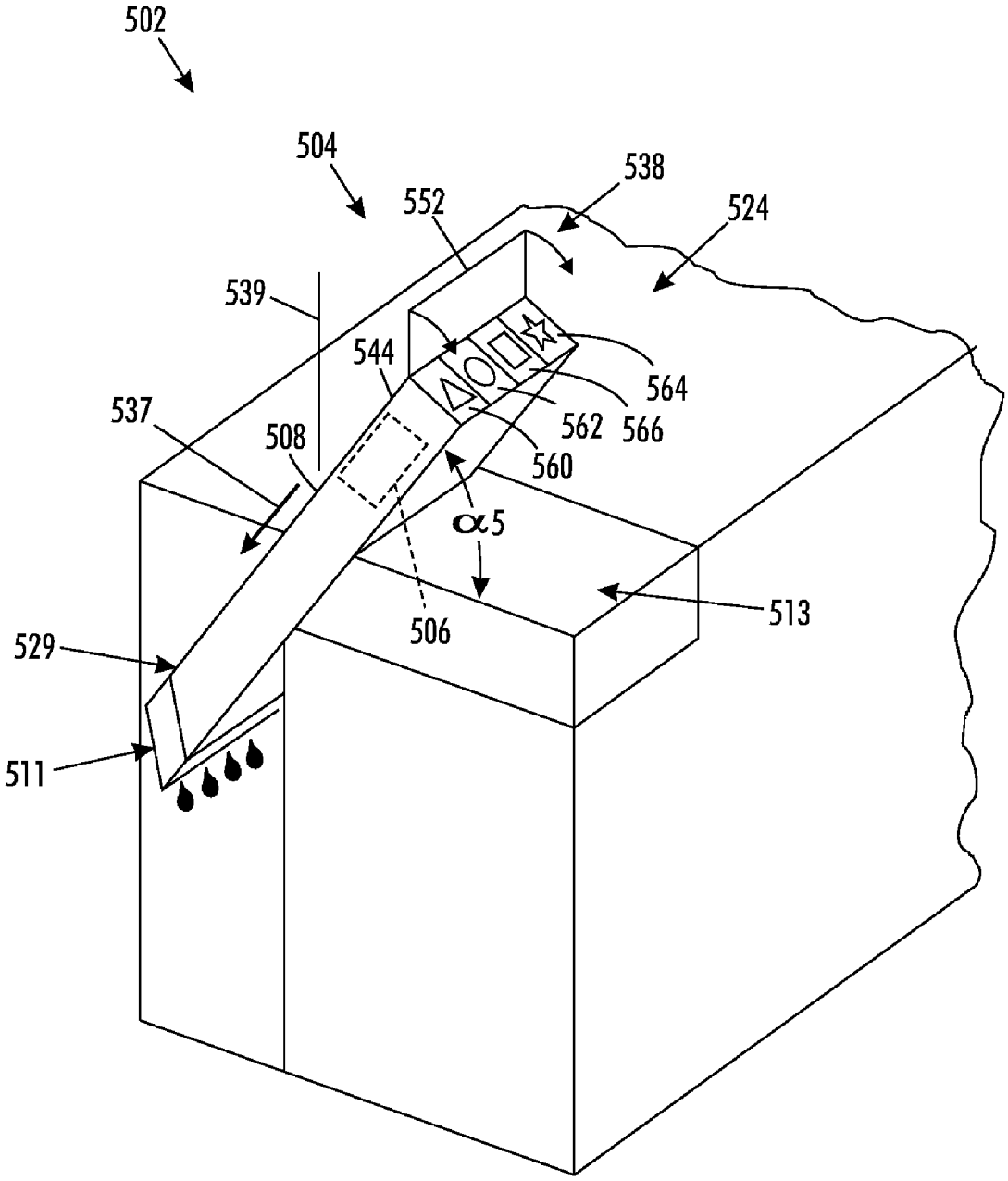
FIG. 15 is a partial perspective view of yet another embodiment of the solid ink delivery system with a chute that has a straight fixed angle with the work surface of the ink printing machine.
Figure 16:
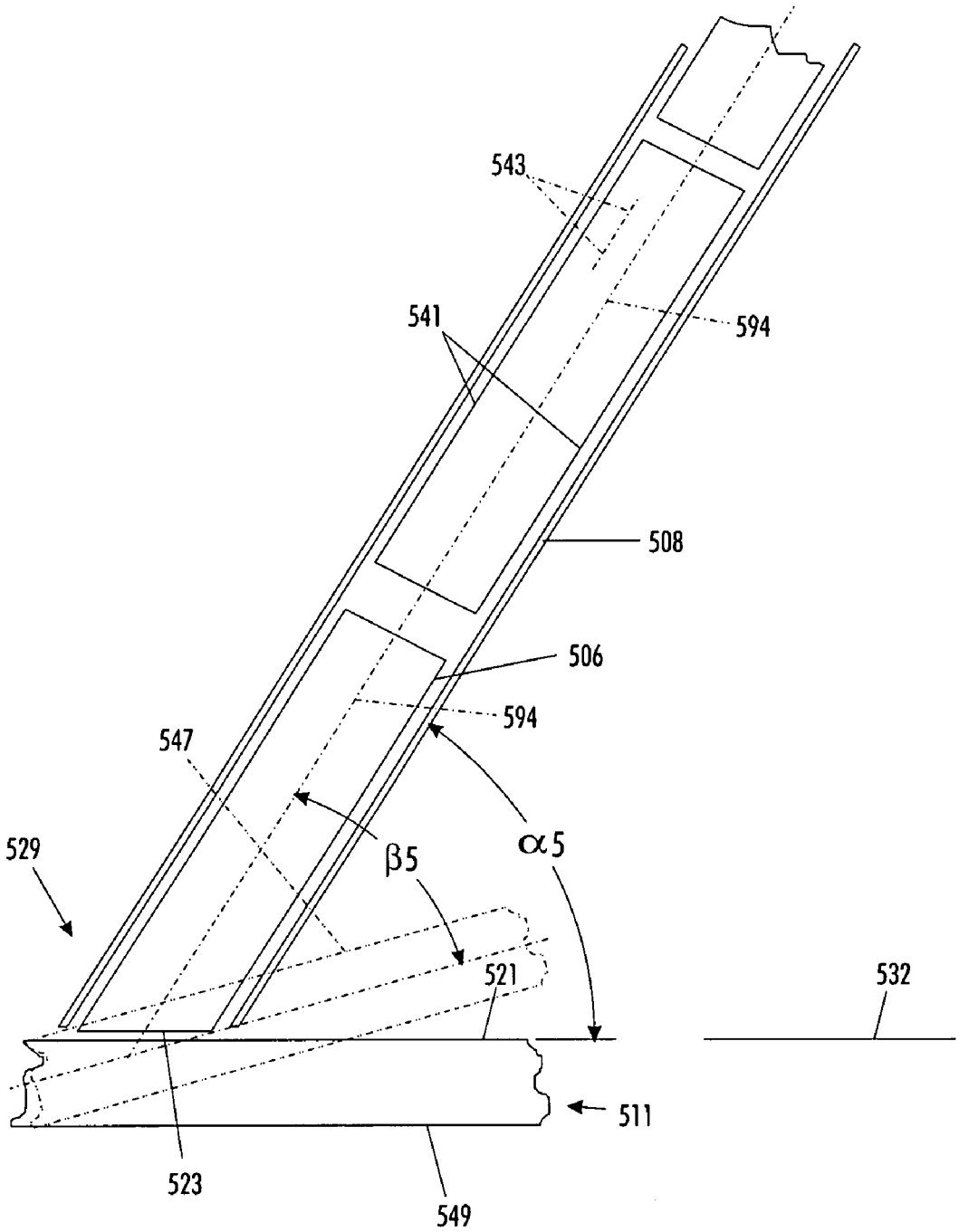
FIG. 16 is a partial plan view of the delivery system of FIG. 15.

Referring now to FIGS. 15 and 16, yet another embodiment is shown as solid ink delivery system 504 for use in printer 502. The printer 502 of FIG. 15, is similar to printer 202 of FIGS. 2-6, but includes a chute or guide 508 that is linear, rather than arcuate. The chute 508, as shown in FIG. 15, is linear or straight and extends from loading station 524 to delivery station 529 adjacent to a melting station having a melting unit 511. An angle α5 is formed between work surface 513 of the printer 502 and chute 508. The work surface 513 may as shown be perpendicular to vertical axis 539. The angle α5 is selected considering the coefficient of friction between solid ink sticks 506 and the chute 508 so that sticks 506 advance in the direction of arrow 537 by gravity through stick opening 538 formed in the chute 508. The angle α5 is determined considering the coefficient of friction between bottom chute surface of periphery 544 of the chute 508 and the outer periphery of the stick 506.

The chute 508 may include a stick opening 538 through which the sticks 506 are inserted into the chute 508. The stick opening 538 may have a hinged clear plastic cover 552 to prevent improper objects from inadvertently falling into the chute 508.

The printer 502 may be a color printer and may thus have the guide 508 include a black chute 560, a cyan chute 562, a magenta chute 566, as well as a yellow chute 564.

It should be appreciated that the chute 508 may be fixed at the angle α5 as determined by design to get the proper rate of fall of the sticks 506 in the chute 508 or may include a device such that the angle α5 may be adjusted or be preset to get the proper angle to get the proper gentle fall of the sticks 506 in the chute 508.

As shown in FIG. 16, the melting unit 511 defines a receiving surface 521 for receiving first end 523 of the sticks 506. The receiving surface 521 is parallel with horizontal plane 532 while the chute 508 is inclined at the angle α5 with respect to the horizontal plane 532. The positioning of longitudinal axis 594 of the sticks 506 at the angle α5 with respect to receiving surface 521 of the melting unit 511 increases the cross-sectional surface that is exposed to the melting unit 511, thereby improving the melting characteristics of the melting unit 511. The angle α5 may be experimentally optimized. It should be appreciated that the angle α5 may also be optimized to obtain the proper gravity flow and movement of the sticks 506 along the chute 508.

Therefore and as shown in FIG. 16, the melting unit 511 rather than being oriented along horizontal plane 532 may be oriented as shown in phantom 547 rather than as shown in solid 549. As shown in phantom 547, the receiving surface 521 of the melting unit 511 forms an angle β5 with respect to longitudinal axis 594 of the stick 506. Therefore and as shown in FIG. 16, the positioning of the melting unit 511 at an inclined angle permits both optimization of the flow of sticks 506 down the chute 508, as well as, optimizing the melting characteristics of the melting unit 511.

As shown in FIG. 16, the sticks 506 in the chute 508 include a first set 541 of opposed surfaces which form the angle α5 with respect to the horizontal plane 532. The sticks 506, as shown in FIG. 16, may have a rectangular cross-section and thus may have a second set 543 of opposed parallel surfaces which are normal with the first set 541 of parallel surfaces such that the second set 543 is normal or perpendicular to the horizontal plane 532.

Figure 17:
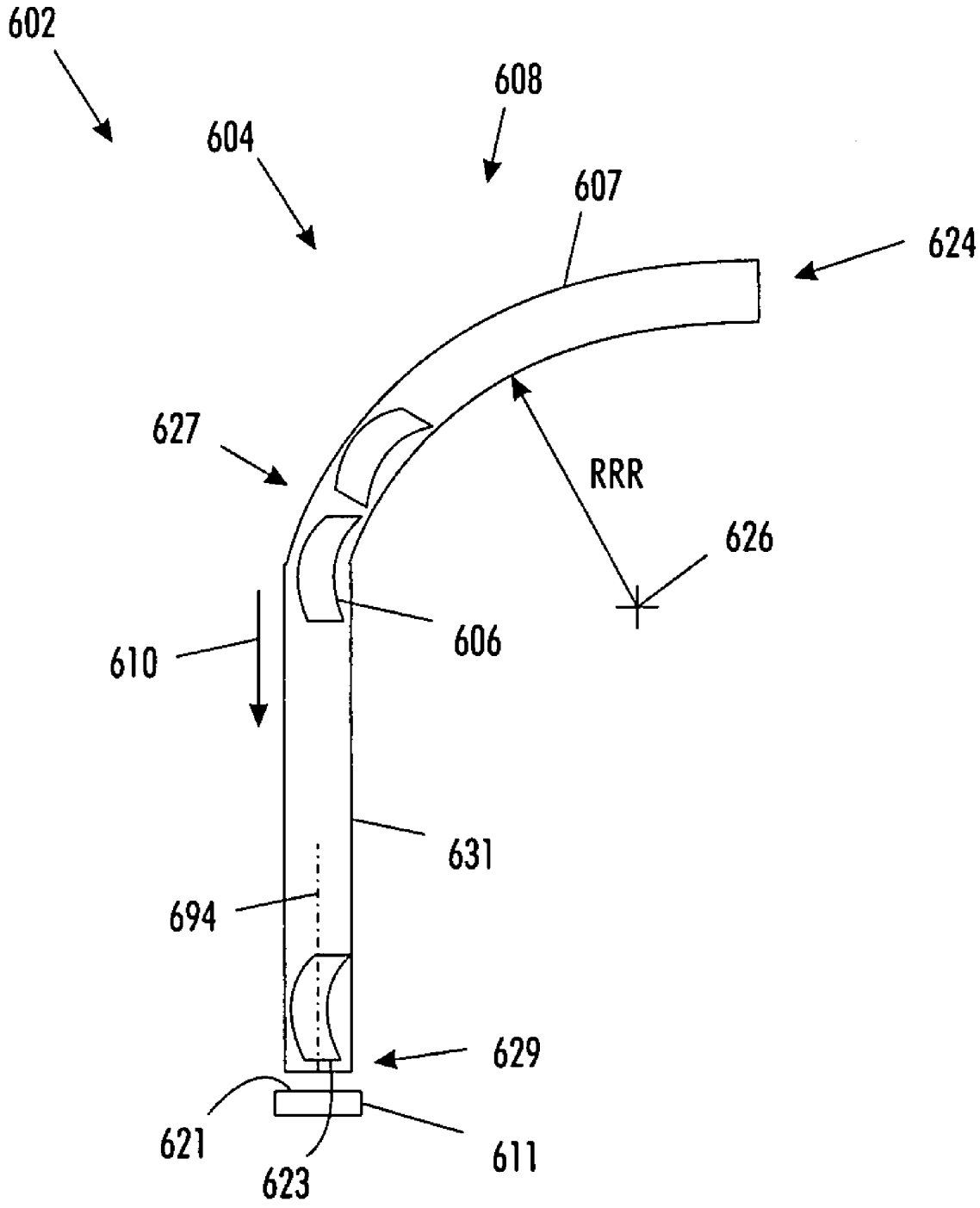
FIG. 17 is a plan view, partially in cross section, of a further embodiment of the solid ink delivery system in the form of a solid ink delivery system with a chute having a linear portion and a curved portion.
Figure 18:
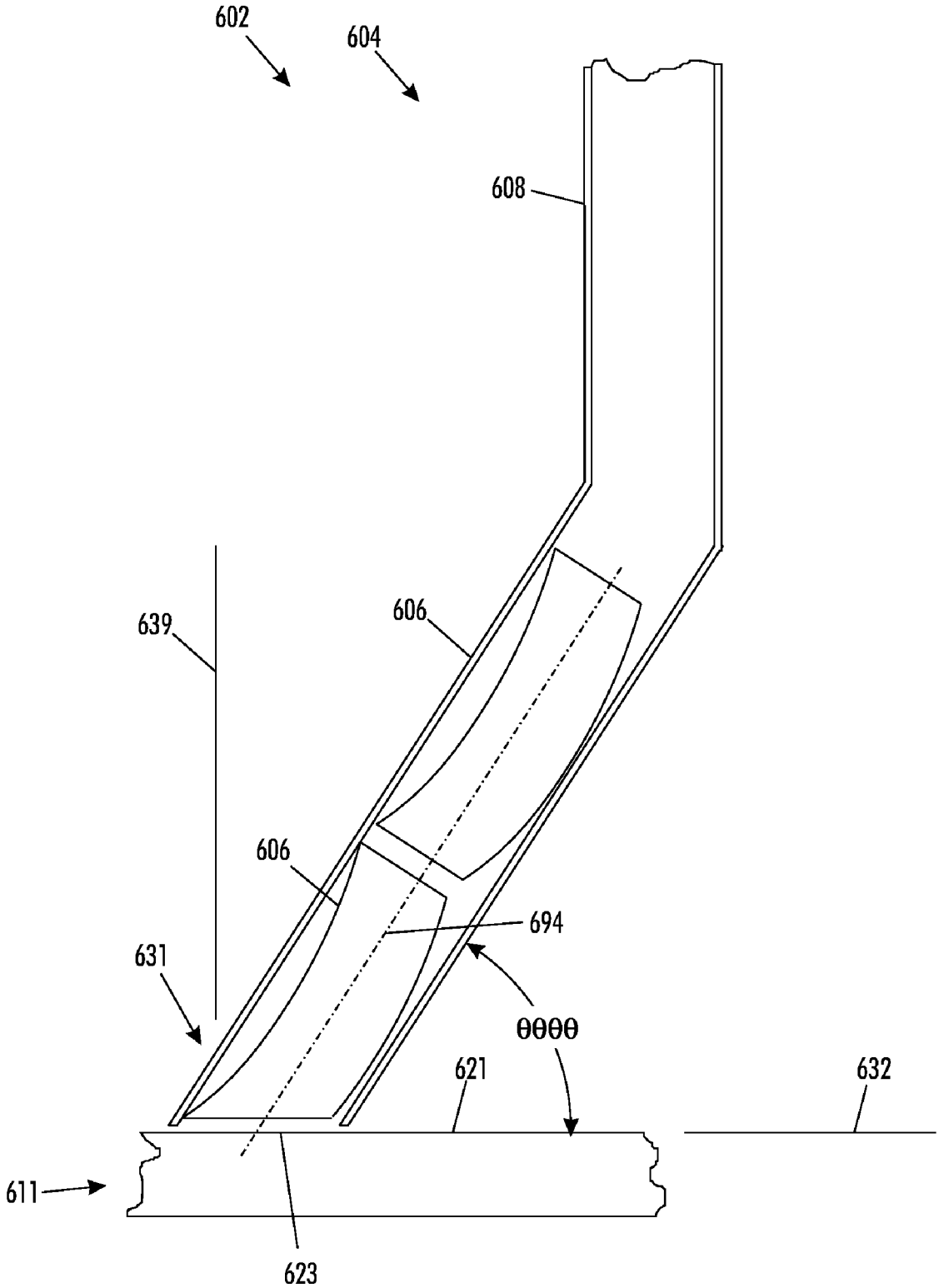
FIG. 18 is a partial end view of the delivery system of FIG. 17.

Referring now to FIGS. 17 and 18, yet another embodiment is shown as printer 602. The printer 602 includes a solid ink delivery system 604 that has a chute 608 that includes an arcuate upper portion 607 and a linear lower portion 631. The arcuate upper portion 607 may extend from the loading station 624 to the transition position 627 located between the arcuate upper portion 607 and the linear lower portion 631 of the chute 608. The arcuate upper portion 607 may be defined by radius RRR extending from origin 626. The linear lower portion 631 extends from the transition position 627 to delivery station 629 adjacent melting unit 611. The linear lower portion 631, as shown in FIG. 17, may be vertical. It should be appreciated that the linear portion 631 may, alternatively, be angled.

The stick 606 for use in the printer 602 may be rectangular or may, as is shown in FIG. 17, be arcuate. The arcuate shape of the stick 606 permits the motion of the stick 606 through the arcuate upper portion 607 and the transition position 627 of the chute 608.

Referring now to FIGS. 17 and 18, the sticks 606 include a first end 623 which contacts receiving surface 621 of the melting unit 611.

As can be seen in FIG. 18, the receiving surface 621 is parallel with horizontal plane 632 and is normal with vertical axis 639. In that the sticks 606 are arcuate, the positioning of the melting unit 611 with respect to the receiving surface 621 at one of a number of angular positions, including that of having the unit 611 normal to the longitudinal axis 694 of the sticks 606, may be optimum.

The lower portion 631 of the chute 608 forms an angle θθθθ with respect to horizontal axis 632. It should be appreciated that the lower portion 631 of the chute 608 may optimally form an acute angle θθθθ with respect to receiving surface 621 of the melting unit 611, if experimental results prove that such position optimizes the melting of the sticks 606. The lower portion 631 in the opposed plane may be normal, or perpendicular, to the horizontal axis 632.

Figure 19:
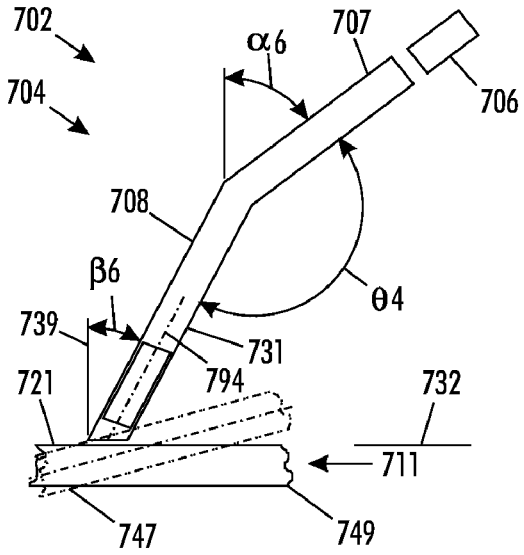
FIG. 19 is a plan view of a further embodiment of the solid ink delivery system in the form of a solid ink delivery system with a chute having a first linear portion and a second linear portion.

Referring now to FIG. 19, yet another embodiment is shown as printer 702. The printer 702 includes a solid ink delivery system 704 which has a chute 708 which is different than the chute 608 of the printer 604 of FIG. 17. The chute 708 receives sticks 706. The chute 708 includes a first linear portion 707 that forms an angle α6 with respect to vertical axis 739 and a second linear portion 731 that forms an angle β6 with the vertical axis 739. The first portion 707 and the second portion 731 form an angle θ4 there between.

The solid ink delivery system 704 includes a melting unit 711. The melting unit 711 defines a receiving surface 721 which is parallel with horizontal plane 732. The angle β6 between the centerline 794 of the sticks 706 and the vertical axis 739 may be optimized to optimize the movement of the sticks 706 in the chute 708.

The melting unit 711 may, as shown in FIG. 19, be positioned such that receiving surface 721 is parallel with horizontal plane 732 as shown in solid position 749. Alternatively the melting unit 711 may be arranged in the position shown in phantom position 747 such that the receiving surface 721 is skewed or forms an angle with respect with horizontal plane 732.

Figure 20:
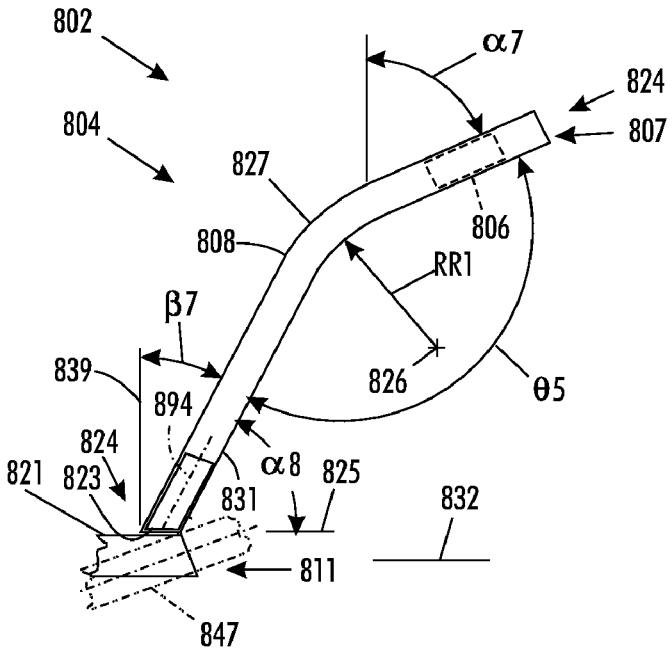
FIG. 20 is a plan view, partially in cross section, of a further embodiment of the solid ink delivery system in the form of a solid ink delivery system with a chute having a first linear portion, a curved portion and a second linear portion.

Referring now to FIG. 20, another embodiment is shown as printer 802. The printer 802 includes a solid ink delivery system 804 which has a chute 808 which has three separate portions for advancing sticks 806. The chute 808 includes a first linear portion 807 that extends downwardly from loading station 824. An arcuate portion 827 connects the first linear portion 807 to a second linear portion 831 that extends downwardly to delivery station 824. The first linear portion 807 forms an angle α7 with respect to the vertical, while the second linear portion 831 forms an angle β7 with respect to vertical axis 839. The first linear portion 807 and the second linear portion 831 are connected by the arcuate portion 827 which defines an angle θ5 there between, as well as a radius RR1 extending from origin 826.

The chute 808 receives sticks 806 which define a first end 823 for contact with receiving surface 821 of melting units 811. The sticks 806 define a longitudinal axis 894 which forms an angle α8 with respect to plane 825 defined by receiving surface 821 of the melting unit 811. It should be appreciated that the angle α8 is selected to optimize the melting of the sticks 806. The melting unit 811, as shown in FIG. 20, is positioned such that receiving surface 821 forms plane 825 which is parallel with horizontal plane 832. It should be appreciated that to optimize the melting of the sticks 806, the melting unit 811 may be positioned in an angled position as shown in phantom as 847.

Figure 20A:
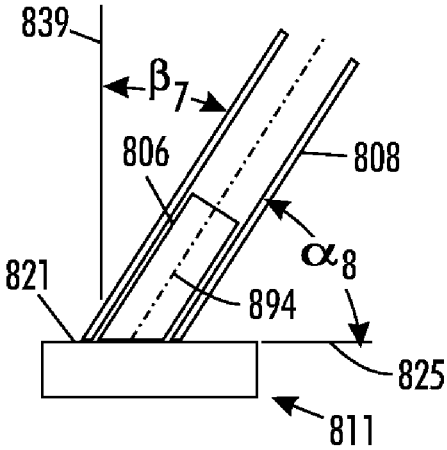
FIG. 20A is a partial plan view of the chute of the solid ink delivery system of FIG. 20 showing the front of the chute adjacent the melting units in greater detail with the melting unit in a horizontal orientation.

Referring now to FIG. 20A, the stick 806 is shown in chute 808 and in contact with receiving surface 821 of melting unit 811. The receiving surface 821 is horizontal or perpendicular to vertical axis 839. The longitudinal axis 894 of the stick 806 forms an angle α8 with respect to plane 825 defined by receiving surface 821 of the melting unit 811.

Figure 20B:
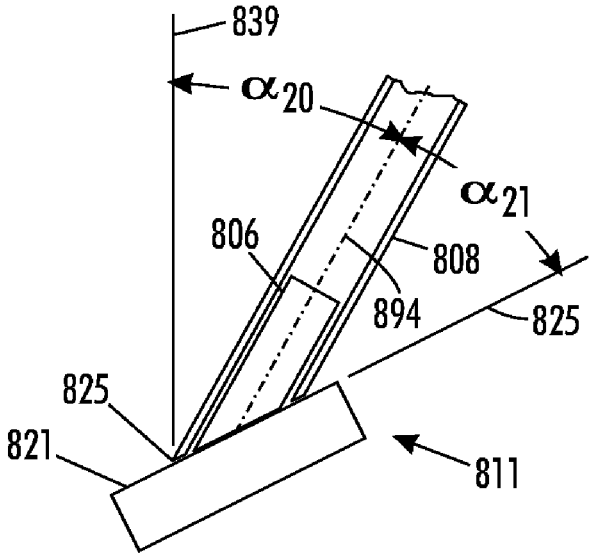
FIG. 20B is a partial plan view of the chute of the solid ink delivery system of FIG. 20 showing the front of the chute adjacent the melting units in greater detail with the melting unit in a skewed orientation.

Referring now to FIG. 20B, the stick 806 is shown in chute 808 and in contact with receiving surface 821 of melting unit 811. The receiving surface 821 is tilted out of horizontal and forms an angle α20 with respect to the vertical axis 839. The longitudinal axis 894 of the stick 806 forms an angle α21 with respect to plane 825 defined by receiving surface 821 of the melting unit 811.

Figure 21:
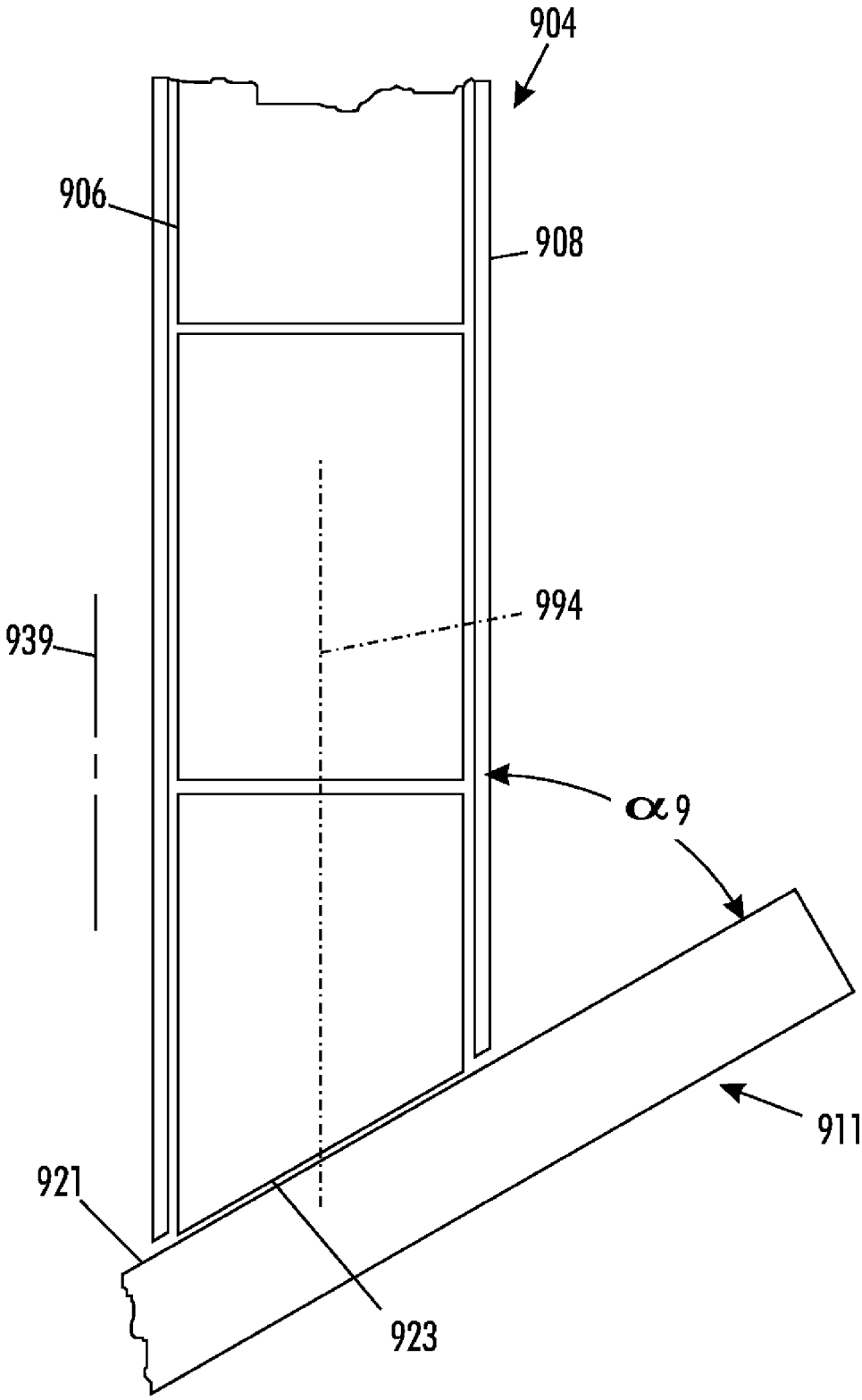
FIG. 21 is a plan view of a further embodiment of the ink delivery system in the form of a gravity fed solid ink delivery system with a chute having an angular relationship with the melting unit of the ink delivery system.

Referring now to FIG. 21, yet another embodiment is shown as ink delivery system 904 for use in a printer. The ink delivery system 904 includes a chute 908 that is positioned vertically with the sticks 906 defining a longitudinal center line 994 which is parallel with vertical axis 939. The sticks 906 define a first end 923 for contact with receiving surface 921 of melting unit 911. The melting unit 911 forms an angle α9 with respect to the longitudinal center line 994 of the sticks 906. It should be appreciated that the angle α9 may be altered and optimized to obtain the optimum melting of the sticks 906.

Figure 22:
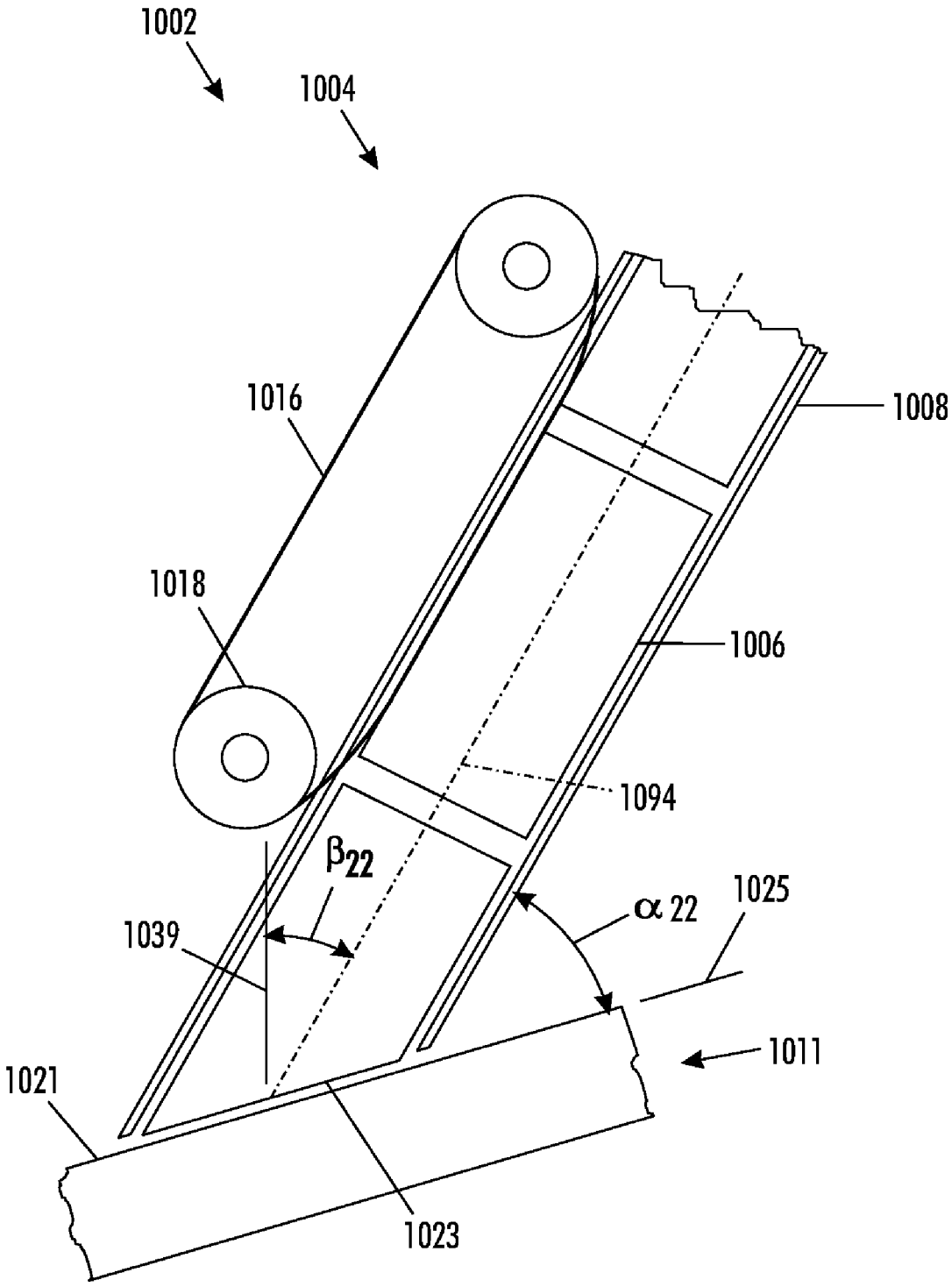
FIG. 22 is a plan view of a further embodiment of the ink delivery system in the form of a belt fed solid ink delivery system with a chute having an angular relationship with the melting unit of the ink delivery system and with the belt nudging the stick into the melting unit.

Referring now to FIG. 22, yet another embodiment is shown as ink delivery system 1004 for printer 1002. The ink delivery system 1004 includes a linear chute 1008 which cooperates with a belt 1016 guided by, for example, a pulley 1018. The belt 1016 urges the sticks 1006 toward the melting unit 1011. The melting unit 1011 defines a receiving surface 1021 for receiving first end 1023 of the sticks 1006. The receiving surface 1021 defines a plane 1025 which forms an angle α22 with respect to the longitudinal center line 1094 of the sticks 1006. The longitudinal center line 1094 of the sticks 1006 forms an angle β22 with respect to vertical axis 1039.

It should be appreciated that the angle α22 may be varied to optimize the melting of the sticks 1006 by the melting unit 1011. The belt 1016 may likewise be utilized to urge the sticks 1006 against the receiving surface 1021 of the melting unit 1011. It should be appreciated that an optimum amount of force by the belt 1016 against the receiving surface 1021 of the melting unit 1011 may optimize the melting of the sticks 1006 by the melting unit 1011.

Figure 23:
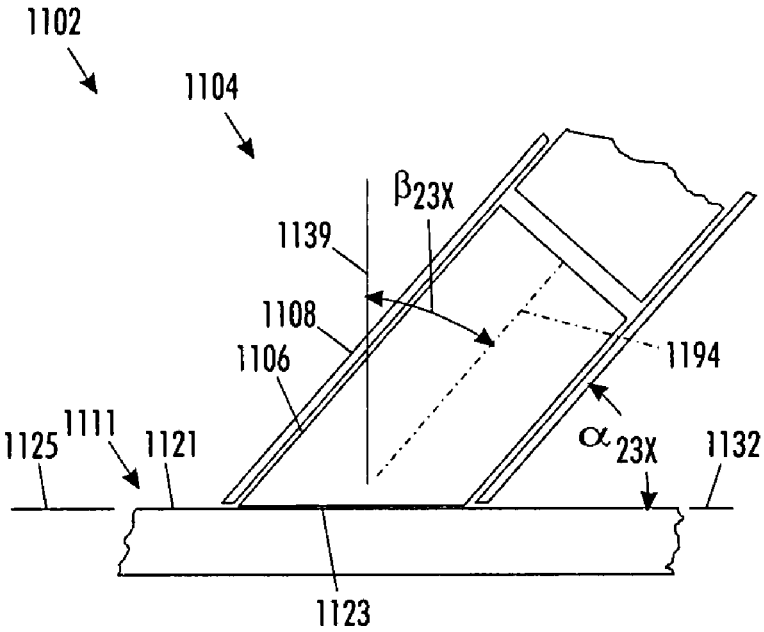
FIG. 23 is a partial plan view of a further embodiment of the ink delivery system in the form of a gravity fed solid ink delivery system with a chute having a compound angular relationship with the melting unit of the ink delivery system.
Figure 24:
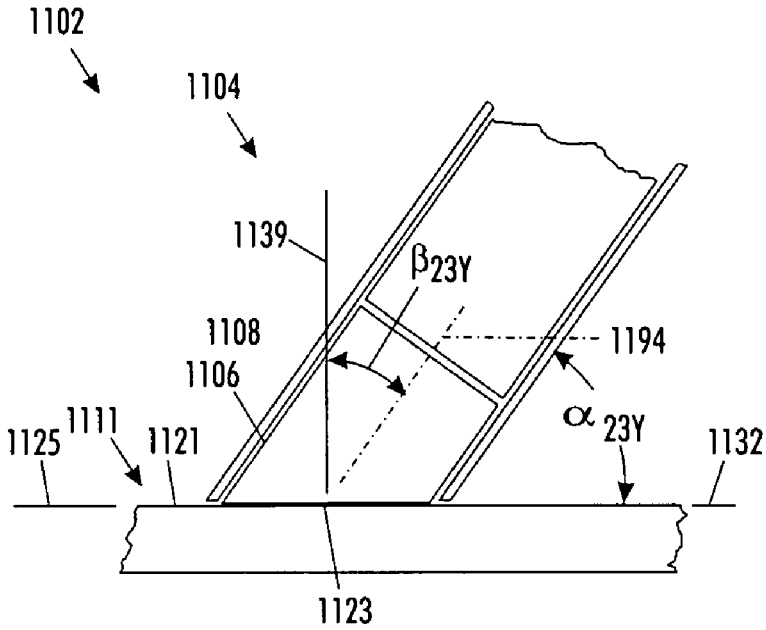
FIG. 24 is a partial end view of the ink delivery system of FIG. 23.

Referring now to FIGS. 23 and 24, yet another embodiment is shown as ink delivery system 1104 for use in printer 1102. The ink delivery system 1104 includes a chute 1108 for guiding sticks 1106 toward melting unit 1111. The chute 1108 is a straight or linear chute and provides that the sticks 1106 define a longitudinal axis 1194 that represents a straight line. The longitudinal axis 1194 of the sticks 1106 form an angle α23*x* in the X plane such that first end 1123 of the ink stick 1106 defines a plane 1125 defined by receiving surface 1121 of the melting unit 1111. The longitudinal axis 1194 of the sticks 1106 forms an angle β23*x* in the X plane with respect to vertical axis 1139.

The receiving surface 1121, as shown in FIGS. 23 and 24, is parallel with horizontal plane 1132. The longitudinal center line 1194 of the sticks 1106 forms the angle α23*x* in the X plane, as well as forms an angle α23*y* in the Y plane, such that the sticks 1106 form a compound angle with respect to the plane 1125 defined by the receiving surface 1121 of the melting unit 1111. The longitudinal axis 1194 of the sticks 1106 forms an angle β23*y* in the Y plane with respect to vertical axis 1139.

It should be appreciated that each α23*x* component and α23*y* component of the compound angle may be altered to optimize the flow of ink by the melting unit 1111. It should further be appreciated that the melting unit 1111 may be positioned such that the receiving surface 1121 forms a single or compound angle with respect to the horizontal plane 1132.

Figure 25:
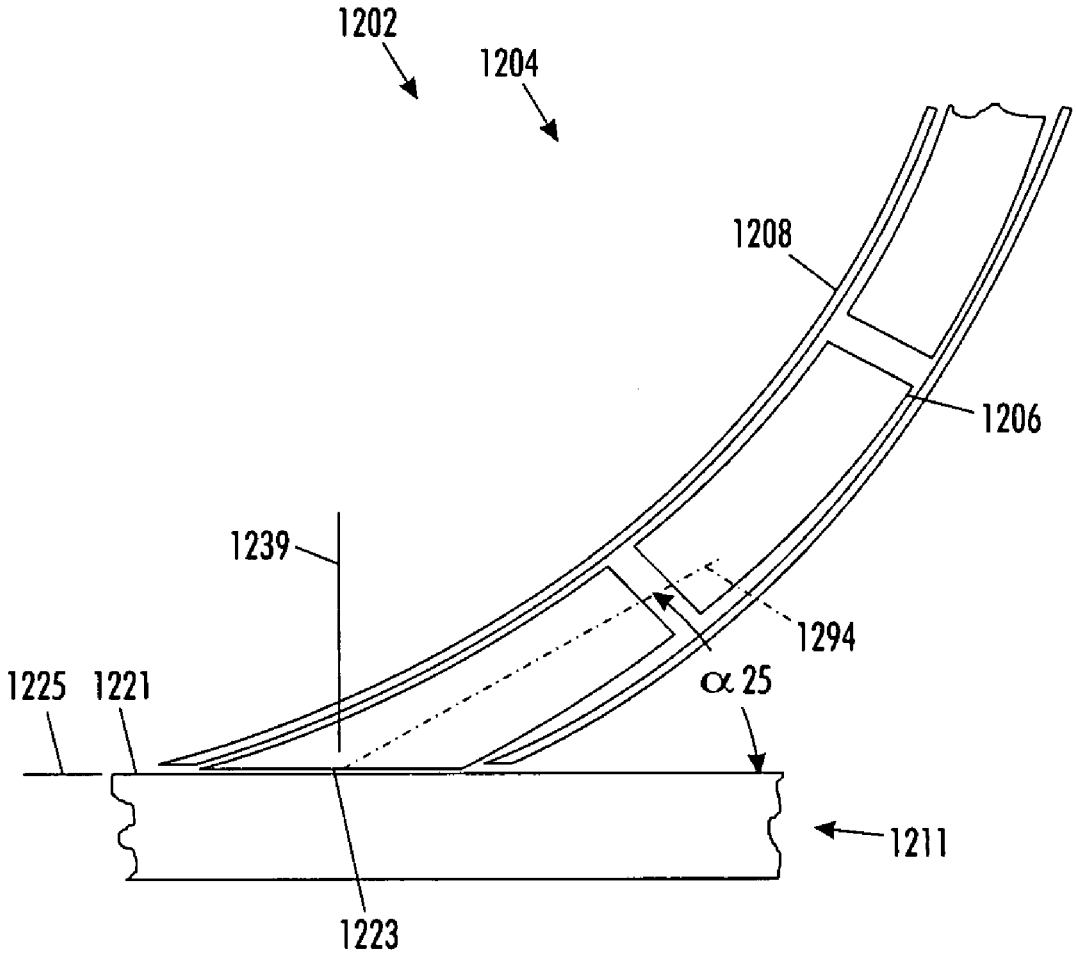
FIG. 25 is a partial plan view of a further embodiment of the ink delivery system in the form of a gravity fed solid ink delivery system with a curved chute having an angular relationship with the melting unit of the ink delivery system.

Referring now to FIG. 25, yet another embodiment is shown as ink delivery system 1204 for use with printer 1202. The ink delivery system 1204 includes chute 1208 which is arcuate. The chute 1208 receives sticks 1206 which are likewise arcuate to conform to the chute 1208. The stick 1206 defines a longitudinal axis 1294 which forms an angle α25 with respect to plane 1225 defined by receiving surface 1221 of melting unit 1211. Plane 1225 may as shown be perpendicular to vertical axis 1239. The sticks 1206 include a first end 1223 which is guided toward receiving surface 1221 of the melting unit 1211. The angle α25 is selected to optimize the flow of melted ink from the ink stick 1206 by the melting unit 1211.

Figure 26:
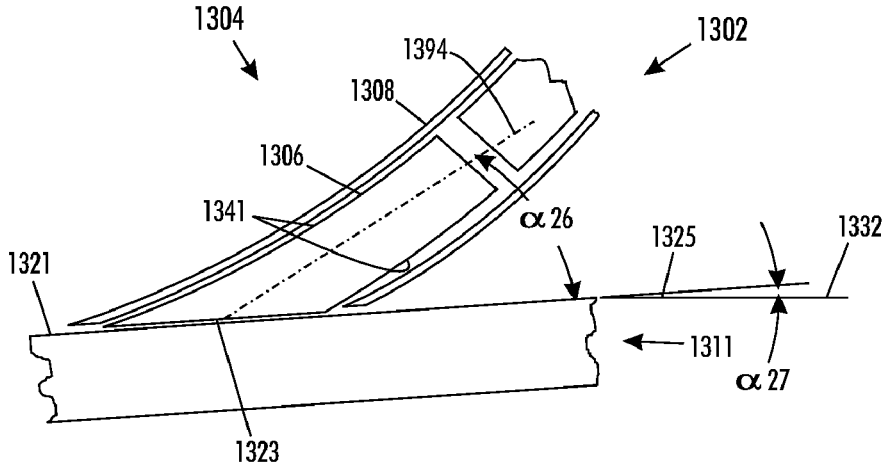
FIG. 26 is a partial plan view of a further embodiment of the ink delivery system in the form of a gravity fed solid ink delivery system with a helical chute having an angular relationship with the melting unit of the ink delivery system.
Figure 27:
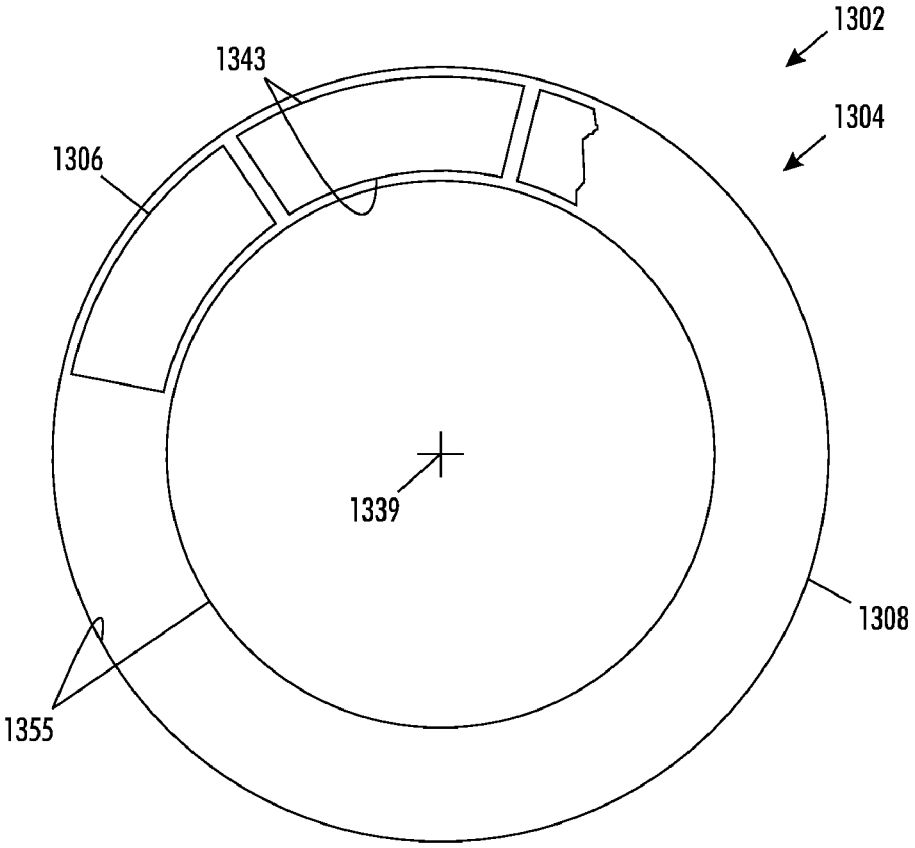
FIG. 27 is a top view of the ink delivery system of FIG. 24.
Figure 28:
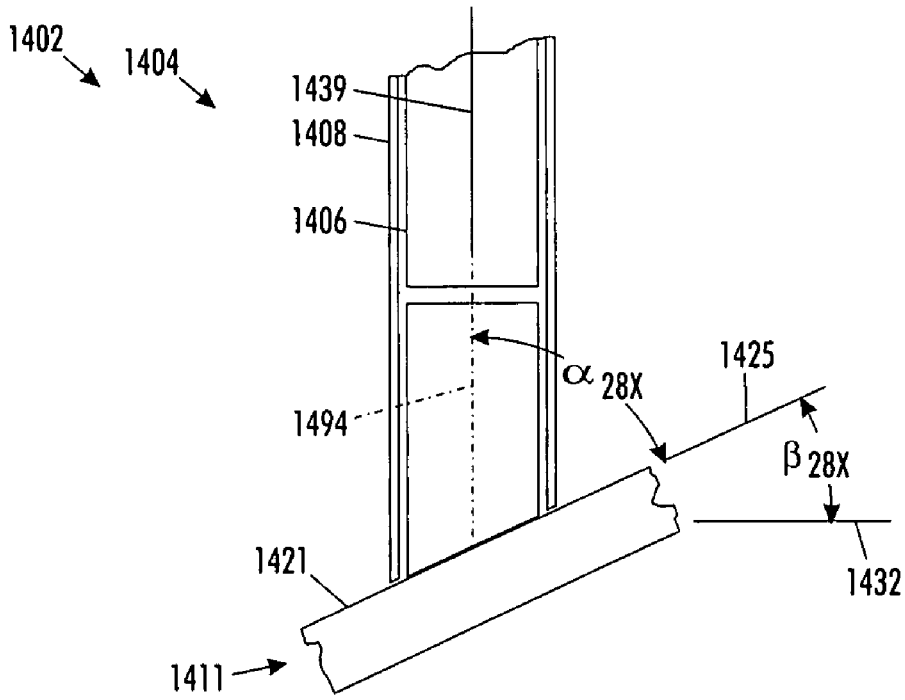
FIG. 28 is a partial plan view of a further embodiment of the ink delivery system in the form of a gravity fed solid ink delivery system with a vertical chute having an angular relationship with an inclined melting unit of the ink delivery system.

Referring now to FIGS. 26 and 27, yet another embodiment is shown as ink delivery system 1304 for printer 1302. The ink delivery system 1304 includes a chute 1308 which is spiral in shape. The chute 1308 may be compatible with ink sticks 1306 which are arcuate both on opposed first sides 1341, as well as on opposed second sides 1343 (FIG. 27). As shown in FIG. 27, the chute 1308 spirals around vertical axis 1339. The chute 1308, as shown in FIG. 28, includes opposed surfaces 1355 which conform to the opposed second sides 1343 of the stick 1306. The stick 1306 includes a first end 1323 for contact with receiving surface 1321 of melting unit 1311. The receiving surface 1321 defines a plane 1325 which forms an angle α26 with respect to longitudinal axis 1394. The angle α26 may be selected to optimize the flow of liquid ink from the stick 1306.

It should be appreciated that the melting unit 1311 may be positioned such that receiving surface 1321 defines plane 1325 which is parallel with horizontal plane 1332. It should be appreciated that to optimize the flow of ink the melting unit 1311 may, as is shown in FIG. 26, be positioned such that plane 1325 forms an angle α27 with the horizontal plane 1332.

Figure 29:
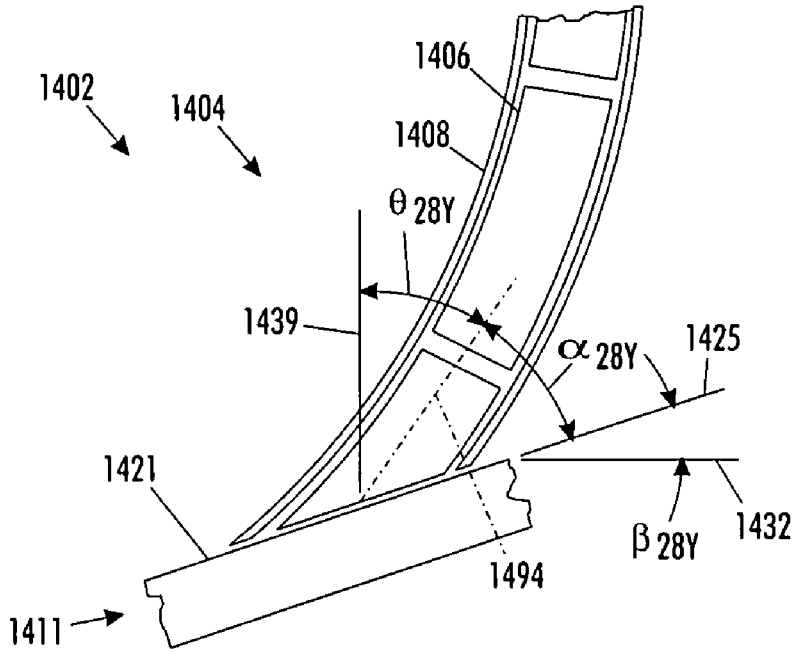
FIG. 29 is a partial plan view of a further embodiment of the ink delivery system in the form of a gravity fed solid ink delivery system with a curved chute having an angular relationship with an inclined melting unit of the ink delivery system.

Referring now to FIGS. 28 and 29, yet another embodiment is shown as ink delivery system 1404 for use in printer 1402. The ink delivery system 1404 includes a chute 1408 for receiving sticks 1406. As shown in FIG. 28, the chute 1408 is vertical in the X plane and referring to FIG. 29 the chute 1408 forms an angle and is arcuate in the Y plane. The sticks 1406 define a longitudinal center line 1494 which forms an angle α28*x* and angle α28*y* in the X and Y planes, respectively, as shown in FIGS. 28 and 29, with plane 1425 formed by receiving surface 1421. The longitudinal axis 1494 of stick 1406 in the X plane is aligned with vertical axis 1439.

The receiving surface 1421 of the melting unit 1411 also forms an angle β28*x* in the X plane and an angle β28*y* in the Y plane with respect to the horizontal plane 1432. It should be appreciated that optimum ink flow from the melting unit 1411 may be accomplished by modifying both or either of the inclination of the melting unit 1411 with respect with the horizontal axis 1432 or by positioning the angle of the chute 1408 with respect to receiving surface 1421. The longitudinal axis 1494 of the stick 1406 engaged with melting unit 1411 forms an angle θ28*y* in the Y plane with respect to vertical axis 1439.

Figure 30:
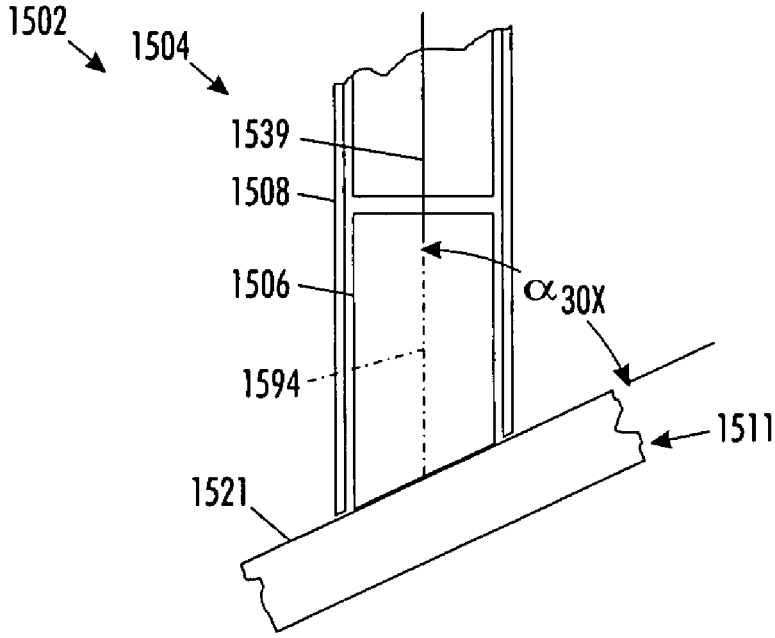
FIG. 30 is a partial plan view of a further embodiment of the ink delivery system in the form of a gravity fed solid ink delivery system with a vertical chute having a compound angular relationship with an inclined melting unit of the ink delivery system.
Figure 31:
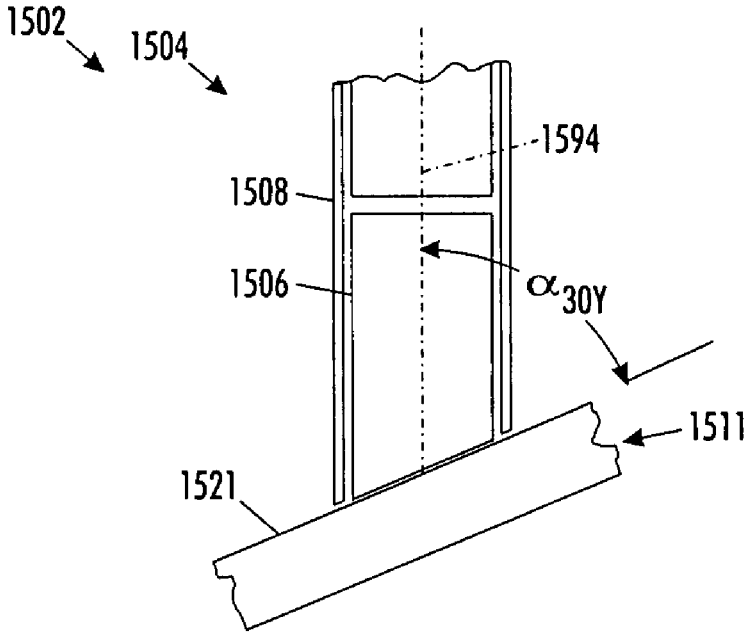
FIG. 31 is an end view of the ink delivery system of FIG. 30.

Referring now to FIGS. 30 and 31, yet another embodiment is shown as ink delivery system 1504 for printer 1502. The ink delivery system 1504 includes a chute 1508 that is positioned vertically with respect to the X plane as shown in FIG. 30 and to the Y plane as is shown in FIG. 31. Longitudinal axis 1594 of the stick 1506 is aligned with vertical axis 1539. The melting unit 1511, as shown in FIGS. 30 and 31, is, however, positioned at a compound angle such that longitudinal axis 1594 of the stick 1506 and receiving surface 1521 of the melting unit 1511 forms an angle α30*x* in the X plane, as shown in FIG. 30, and an angle α30*y* in the Y plane, as shown in FIG. 31. It should be appreciated that the angles α30*x* and α30*y* may be selected by altering the positioning of the melting unit 1511 to optimize the melting of ink by the melting unit 1511.

Figure 32:
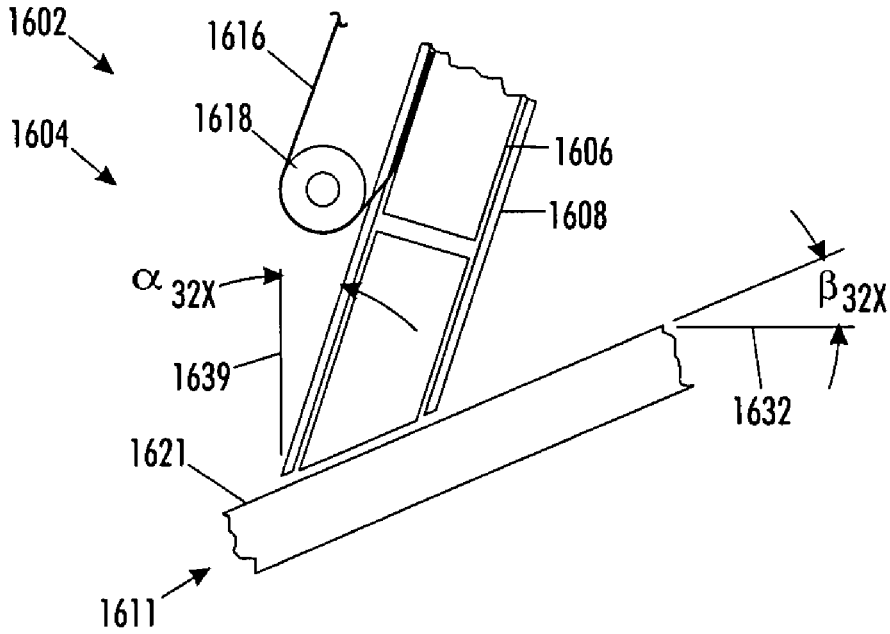
FIG. 32 is a partial plan view of a further embodiment of the ink delivery system in the form of a belt fed solid ink delivery system with a vertical chute having a compound angular relationship with an inclined melting unit of the ink delivery system.
Figure 33:
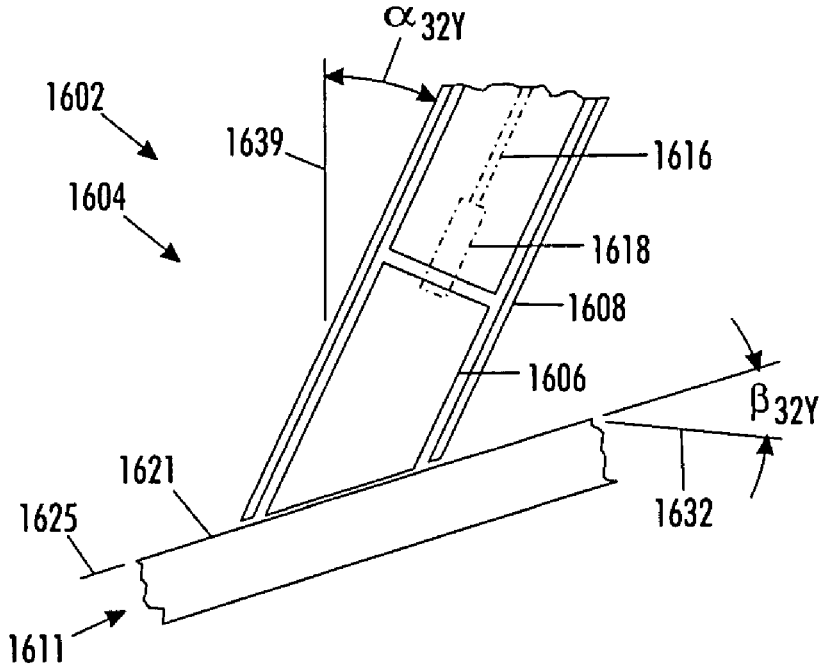
FIG. 33 is a partial end view of the ink delivery system of FIG. 32.

Referring now to FIGS. 32 and 33, yet another embodiment is shown as ink delivery system 1604. The ink deliver system 1604 is for use with printer 1602. The ink delivery system 1604 includes a melting unit 1611 that is positioned at a compound angle defined as angles β32*x* in the X plane and β32*y* in the Y plane with respect to horizontal plane 1632. Similarly, the chute 1608 which may, as shown in FIGS. 32 and 33, be a linear chute is positioned at a compound angle, for example angle α32*x* in the X plane with respect to the vertical axis 1639 and an angle α32*y* in the Y plane with respect to the vertical axis 1639. It should be appreciated that to optimize the melting of sticks 1606, the orientation of the melting unit 1611 may be altered, as well as the inclination and attitude of chute 1608.

It should be appreciated that positioning of the angle of the chute 1608 may be limited by its ability to drop the ink sticks by gravity toward the melting unit 1611. The ink delivery system 1604, as shown in FIGS. 32 and 33, includes a belt 1616 that is driven by pulley 1618 to assist in advancing the stick 1606 in the chute 1608. It should be appreciated that the belt 1616 may further be utilized to urge the stick 1606 toward receiving surface 1621 of the melting unit 1611. It should be appreciated that the use of the belt 1616 to urge the stick 1606 toward the melting unit 1611 may be optimized to optimize the melting of ink stick 1606 by the melting unit 1611.

Figure 34:
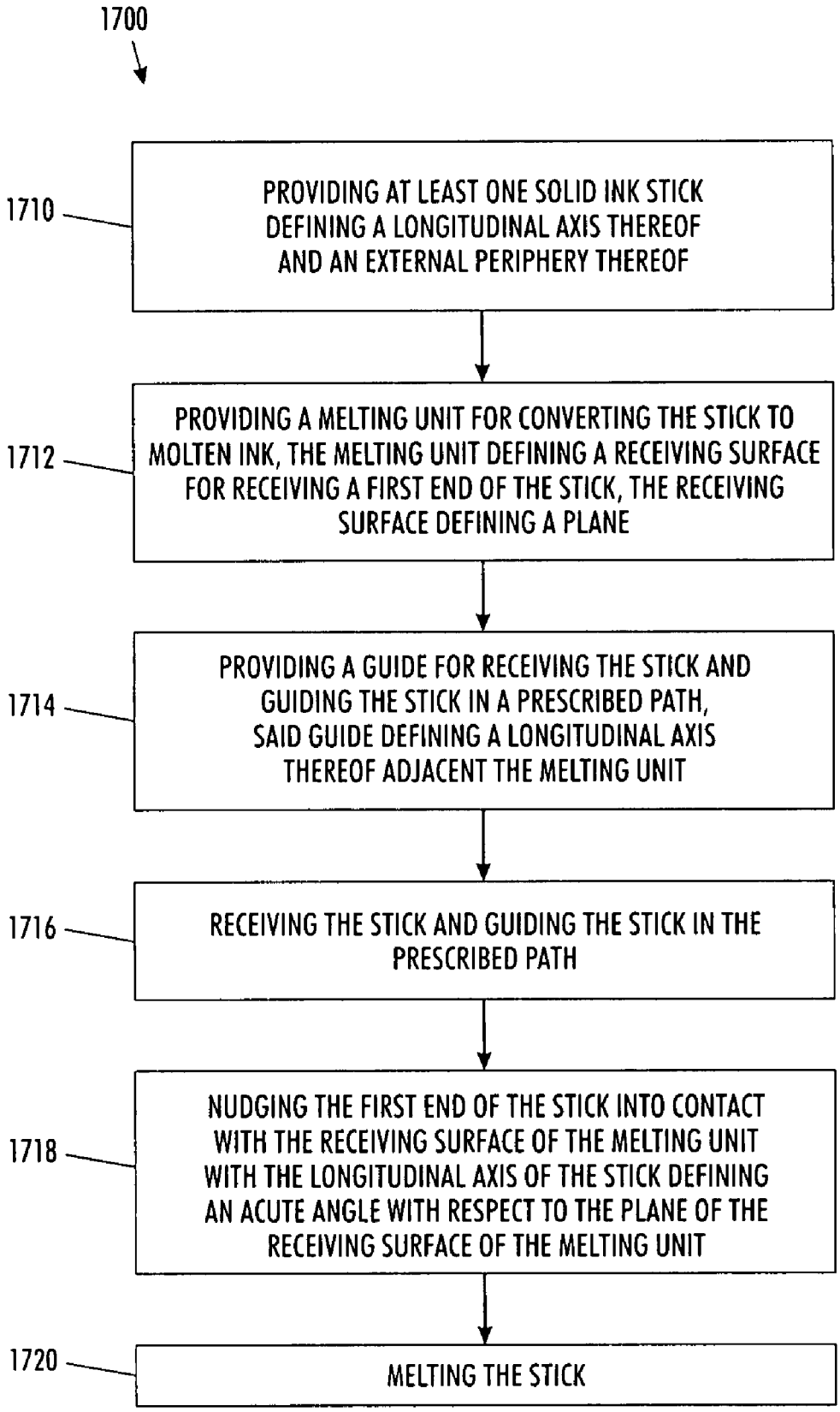
FIG. 34 is a flowchart detailing the basic steps of advancing ink in a solid ink printer.

Referring now to FIG. 34, yet another embodiment is shown as method 1700 of converting solid ink sticks received into the printer to molten ink so that the ink may be transferred to media to form an image on the media. The method 1700 includes a first step 1710 of providing at least one solid ink stick defining a longitudinal axis of the stick and an internal periphery of the stick. The method 1700 includes a second step 1712 of providing a melting unit for converting the stick to molten ink. The melting unit defines a receiving surface for receiving a first end of the stick. The receiving surface defines a plane.

The method 1700 further includes a third step 1714 of providing a guide for receiving the stick and guiding the stick in a prescribed path. The guide defines a longitudinal axis of the guide which is adjacent the melting unit. The method 1700 further includes a fourth step 1716 of receiving the stick and guiding the stick in a prescribed path as well as a fifth step 1718 of nudging the first end of the stick into contact with the receiving surface of the melting unit with the longitudinal axis of the stick defining an acute angle with respect to the plane of the receiving surface of the melting unit. The method 1700 further includes a sixth step 1720 of melting the stick.

Variations and modifications of the system described herein are possible, given the above description. However, all variations and modifications which are obvious to those skilled in the art to which the described system pertains are considered to be within the scope of the protection granted by this Letters Patent.

What is claimed is:

1. A solid ink delivery system for use in a solid ink printer, said solid ink delivery system being configured to receive a solid ink stick and converting the solid ink stick to liquid ink that may be ejected onto media to form an image, said solid ink delivery system comprising:

a guide configured to receive a solid ink stick and guide the solid ink stick in a prescribed path;

a melting unit operably associated with said guide, said melting unit being configured to melt the solid ink stick to form liquid ink, said melting unit having a receiving surface that receives a first end of the solid ink stick, the receiving surface defining a plane that is positioned at an acute angle with respect to a longitudinal axis of said guide; and the solid ink stick having a first set of opposed surfaces and a second set of opposed surfaces, one of the surfaces in the first set of opposed surfaces defining a first stick surface plane that is positioned at an acute angle with the melting area plane when the solid ink stick is in the guide, and the second set of opposed surfaces being normal to the first set of the opposed surfaces of the stick with one surface in the second set of opposed surfaces defining a second stick surface plane that is positioned at a right angle to the plane of the melting area receiving surface.

2. The solid ink delivery system of claim 1, wherein the first set and second set of opposed surfaces extend along a longitudinal axis of the solid ink stick, and at least one set of said first and said second sets of opposed surfaces are arcuate along the longitudinal axis of the solid ink stick.

3. The solid ink delivery system of claim 1, wherein one set of the first set of opposed surfaces and the second set of opposed surfaces includes a first stick external surface that is at least partially concave and a second stick external surface that is at least partially convex.

4. The solid ink delivery system of claim 1:

wherein the solid ink stick has a first stick external surface that is at least partially concave and a second stick external surface that is at least partially convex.

5. A solid ink delivery system for use in a solid ink printer. said solid ink delivery system being configured to receive a solid ink stick and converting the solid ink stick to liquid ink that may be ejected onto media to form an image, said solid ink delivery system comprising:

a guide configured to receive a solid ink stick and guide the solid ink stick in a prescribed path;

a melting unit operably associated with said guide, said melting unit being configured to melt the solid ink stick to form liquid ink, said melting unit having a receiving surface that receives a first end of the solid ink stick, the receiving surface defining a melting area plane that is positioned at an acute angle with respect to a longitudinal axis of said guide; and the solid ink stick has a first set of opposed surfaces, one surface of the first set of opposed surfaces defining a first stick surface plane, the first stick surface plane and the melting area plane defining an acute angle therebetween when the first stick surface plane is adjacent the melting area plane; and the solid ink stick also has a second set of opposed surfaces, the second set of opposed surfaces being approximately normal to the first set of opposed surfaces of the stick, one surface of the second set of the opposed surfaces defining a second stick surface plane, the second stick surface plane and the melting area plane defining an acute angle therebetween when the second stick surface plane is adjacent the melting plane location.

6. A printer having an ink delivery system for use with a solid ink stick, said printer comprising:

a guide for receiving a solid ink stick and guiding the solid ink stick in a prescribed path;

a melting unit operably associated with said guide, said melting unit being configured to melt the solid ink stick, said melting unit having a receiving surface for receiving a first end of the solid ink stick, the receiving surface defining a melting area plane that is positioned at an acute angle with respect to a longitudinal axis of said guide;

the solid ink stick having a first set of opposed parallel surfaces and a second set of opposed parallel surfaces, the second set of opposed parallel surfaces being normal to the first set of the opposed parallel surfaces of the solid ink stick, one surface of the first set of the opposed parallel surfaces defining a first stick surface plane, the first stick surface plane and the melting area plane defining an acute angle therebetween when the first end of the solid ink stick is adjacent the receiving surface, and one surface of the second set of opposed parallel surfaces defining a second stick surface plane, the second stick surface plane and the melting area plane defining a right angle therebetween when the first end of the solid ink stick is adjacent the receiving surface.

7. The printer of claim 6, wherein the first set of opposed parallel surfaces of the solid ink stick includes a first external surface and a second external surface, each external surface extends along the longitudinal axis of the stick, at least one of said first and second external surfaces being arcuate along the longitudinal axis of the stick.

8. The printer of claim 6, wherein the first set of opposed parallel surfaces of the solid ink stick includes a first external surface and a second external surface, said first external surface being concave and said second external surface being convex.

9. A printer having an ink delivery system for use with a solid ink stick, said printer comprising:

a guide for receiving a solid ink stick and guiding the solid ink stick in a prescribed path;

a melting unit operably associated with said guide, said melting unit being configured to melt the solid ink stick, said melting unit having a receiving surface for receiving a first end of the stick, the receiving surface defining a melting area plane that is positioned at an acute angle with respect to a longitudinal axis of said guide;

wherein the solid ink stick has a first set of opposed parallel surfaces, one surface of the first set of opposed parallel surfaces defining a first stick surface plane, the first stick surface plane and the melting area plane defining an acute angle therebetween; and wherein the solid ink stick has a second set of opposed parallel surfaces, the second set of opposed parallel surfaces being normal to the first set of the opposed parallel surfaces of the solid ink stick, one surface of the second set of the opposed parallel surfaces defining a second stick surface plane, the second stick surface plane and the melting area plane defining an acute angle therebetween.

10. A method of converting solid ink sticks received into a printer to molten ink so that the ink may be transferred to media to form an image thereon, said method comprising steps of:

moving along a longitudinal axis of a guide at least one solid ink stick having a longitudinal axis and an external periphery melting the solid ink stick with a melting unit as the solid ink stick exits the guide, the melting unit defining a receiving surface that forms an acute angle with a first set of opposed sides of the solid ink stick as the melting unit melts the solid ink stick and that forms a right angle with a second set of opposed sides of the solid ink stick.

11. The method of claim 10 further comprising:

aligning the longitudinal axis of the solid ink stick with the longitudinal axis of the guide as the solid ink stick is inserted into the guide.

12. The method of claim 10, wherein the longitudinal axis of the guide defines a linear path for the solid ink stick.

13. The method of claim 10, wherein the longitudinal axis of the guide defines an arcuate path for the solid ink stick.

* * * * *